US009867485B2

(12) United States Patent
Cavosie et al.

(10) Patent No.: US 9,867,485 B2
(45) Date of Patent: Jan. 16, 2018

(54) METHODS, SYSTEMS, AND DEVICES FOR COMBINATION DUVET COVER AND COMFORTER

(71) Applicant: TARAMISUE, LLC, Albany, NY (US)

(72) Inventors: Tara J. Cavosie, Loudonville, NY (US); Susan D. Brown, Loudonville, NY (US)

(73) Assignee: TARAMISUE, LLC, Loudonville, NY (US)

( * ) Notice: Subject to any disclaimer, the term of this patent is extended or adjusted under 35 U.S.C. 154(b) by 0 days.

(21) Appl. No.: 14/990,435

(22) Filed: Jan. 7, 2016

(65) Prior Publication Data

US 2016/0192793 A1 Jul. 7, 2016

Related U.S. Application Data

(60) Provisional application No. 62/104,199, filed on Jan. 16, 2015, provisional application No. 62/100,806, filed on Jan. 7, 2015.

(51) Int. Cl.
*A47G 9/02* (2006.01)

(52) U.S. Cl.
CPC ..... *A47G 9/0261* (2013.01); *A47G 9/02* (2013.01)

(58) Field of Classification Search
CPC ..... A47G 9/02
USPC ..... 5/482, 485–486, 496, 500–502
See application file for complete search history.

(56) References Cited

U.S. PATENT DOCUMENTS 6,032,308 A * 3/2000 Chuang ..... A47G 9/0261 5/413 AM

OTHER PUBLICATIONS

"DuZipp," retrieved from http://duzipp.storenvy.com/products, Dec. 6, 2016, pp. 1-2.
"Du-Zipp," retrieved from https://www.facebook.com/DuZipp/, Dec. 6, 2016, pp. 1-8.

* cited by examiner

*Primary Examiner* — Fredrick Conley
(74) *Attorney, Agent, or Firm* — One LLP

(57) ABSTRACT

A system, method and apparatus of joining a duvet cover with a comforter are described including a duvet cover having two opposing interior surfaces defining an interior cavity and having an opening such that a user can access the interior cavity of the duvet cover, a comforter having two opposing exterior surfaces and operable to be inserted at least partially inside the duvet cover through the opening, and a first fastener of the comforter and a second fastener of the interior cavity of the duvet cover, wherein the first fastener and second fastener are compatible and operable to be joined, such that when joined they at least partially prevent movement of the comforter with respect to the interior cavity of the duvet cover.

20 Claims, 32 Drawing Sheets

METHODS, SYSTEMS, AND DEVICES FOR COMBINATION DUVET COVER AND COMFORTER

CROSS REFERENCE TO RELATED APPLICATIONS

The present application claims priority to U.S. Provisional Application No. 62/100,806 filed Jan. 7, 2015 titled "COMBINATION DUVET COVER AND COMFORTER SYSTEM" and U.S. Provisional Application No. 62/104,199 filed Jan. 16, 2015 titled "COMBINATION DUVET COVER AND COMFORTER SYSTEM," which are hereby incorporated by reference in their entirety and for all purposes.

FIELD OF THE INVENTION

The field of the invention relates generally to the field of duvets/comforters and duvet covers.

BACKGROUND OF THE INVENTION

Existing duvet covers use clips, snaps, ties or pins located generally in the corners to secure a comforter to a duvet cover. Unfortunately, these clips, snaps, ties and pins often became unattached from the comforter during sleep and bed-making, resulting in misalignment, bunching, tangling and twisting of the comforter inside the duvet cover. All of these factors create an uncomfortable sleep experience and sloppy appearance and often result in wasted time for users in fixing the arrangement between the comforter and duvet cover.

One prior art solution is the "Du-Zipp" (sold online at https://www.etsy.com/shop/DuZipp) which is described as A zipper is sewn on the interior of the duvet and duvet cover on the seams. This method involves attaching a zipper to the interior side seam of a duvet cover but not within the layers of the duvet. As a result, all parts of the zipper (the zipper tape, the zipper teeth and the zipper slider) are all visible to the eye. A similar method is used on the duvet (comforter). This method attaches a zipper on top of a duvet (comforter) and as a result, all parts of the zipper (the zipper tape, the zipper teeth and the zipper slider) are visible to the naked eye, while in some a secondary strip of material is added over the exposed zipper in an attempt to hide the zipper, increasing cost and decreasing aesthetic appeal.

Thus, needs exist for improved techniques to create secure connections between comforters and duvet covers.

SUMMARY

Provided herein are embodiments of devices, systems and methods for improved securing of duvet cover and comforters. These improved systems, devices and methods include one or more of the following improvements. In some embodiments, certain fasteners will be attached along one or more interior sides of a duvet cover while complementary fasteners will also be attached along one or more corresponding sides of a comforter. In some embodiments, the comforter can be inserted into the duvet cover and, once inserted, the complementary fasteners on the sides of the comforter can be aligned with and attached or otherwise coupled to the complementary fasteners on the interior sides of the duvet cover. In some embodiments, a comforter and duvet cover can be joined by turning the duvet cover inside out, attaching the fasteners of the comforter to those of the duvet cover and then flipping the duvet cover right side out for normal use with the comforter located therein. Once connected, attached or otherwise coupled, the comforter can be securely attached to the duvet cover and will have a greatly reduced chance of becoming bunched up, tangled or twisted within the duvet cover. Fasteners can include many different types and combinations including hook and loop, hook and eye, zipper, snaps and others.

Methods, systems and devices included herein can separate a zipper into two parts or halves, a male and female part respectively. One half of the zipper can be inserted between the top and bottom layers of a duvet cover so that a majority of zipper tape is hidden within the duvet cover layers, leaving only zipper teeth and a zipper slider and a very small portion of zipper tape visible to the eye from either an interior or exterior view. The other half of the zipper can be inserted between the top and bottom layers of the duvet (comforter) so that a majority of zipper tape can be hidden within the top and bottom layers, leaving only zipper teeth and zipper slider and a very small portion of zipper tape visible to the eye from an exterior view. Once the two halves of the zippers are aligned and engaged, for example, within an interior area of the duvet cover, the duvet cover and duvet (comforter) become connected.

The placement of the zippers can be important for several reasons:

Concealing zipper tape in between the top and bottom layers of both a duvet and duvet cover can prevent the zippers from becoming unattached from either the duvet or the duvet cover due to repeated use (zipping and unzipping), motion during a laundering process or movement during sleep.

In addition, concealment of zipper tape can be important because it can prevent damage to both the duvet & duvet cover from the zipper tape that may have sharp edges which could cause a tear in the fabric of either the duvet or duvet cover.

Also, zipper tape material can fray & break apart due to repeated use (zipping and unzipping), motion during the laundering process or movement during sleep, leading to inoperable zippers. Concealing and securing the zipper between the layers can protect from this and prevent fraying of fabric.

When zipper tape is attached by insertion between layers, the attachment can be more secure because the layers as well as sewing or otherwise stitching hold the zipper in place, resulting in a more secure and functional operation.

Positioning the zippers between layers can also create a clean, aesthetically-pleasing appearance for each piece.

Not mentioned in the prior art but described herein is a uniform placement of all sliders. If multiple zippers are included, all halves of the zipper with sliders can be positioned on the duvet (comforter), with all non-slider halves on the duvet cover or the inverse positioning.

While some prior art describes "exterior view with zippers attached," users cannot see the duvet/duvet cover connection zippers as described herein once the duvet and duvet cover are attached, and the pieces are in their final position and the combination is seen from an exterior view. This can be important because having duvet/duvet cover connections on the exterior of the finished product can result in discomfort if the zipper comes in contact with the user and may even cause injury, skin irritation or other issues. Additionally, seeing duvet cover/duvet attachment zippers on the exterior is not aesthetically pleasing.

While some prior art solutions describe "creating one solid unit," the duvet covers described herein include interior edges which can connect directly to a duvet's exterior edges, leaving the body of the duvet free from attachment to the body of the duvet cover, allowing the two pieces to function together, while still allowing air to flow between the pieces for breathability.

Herein, a zipper construction and placement is unique. Side length zippers, when inserted within the layers of the duvet cover and duvet and then connected, can result in the slider of a zipper (the part of the zipper you pull with your hand) terminating near the foot of the duvet/duvet cover combination. This can result in comfort and uniformity. In order to achieve this effect, one side length zipper can be fitted with a right hand separator, and the other side length zipper can be fitted with a left hand separator.

In some embodiments described herein, duvet and duvet covers can be pre-manufactured in a factory and zippers can be added within the layers during the original manufacturing process of both the duvet and duvet covers. As such, manufacturing using CAD (Computer Aided Design), patterns can include making and manufacturing technology to create a precision fit. This is in contrast to prior art solutions which may be added in a secondary process.

Other systems, devices, methods, features and advantages of the subject matter described herein will be or will become apparent to one with skill in the art upon examination of the following figures and detailed description. It is intended that all such additional devices, methods, features and advantages be included within this description, be within the scope of the subject matter described herein, and be protected by the accompanying claims. In no way should the features of the example embodiments be construed as limiting the appended claims, absent express recitation of those features in the claims.

BRIEF DESCRIPTION OF THE DRAWING(S)

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

Illustrated in the accompanying drawing(s) is at least one of the best mode embodiments of the present invention In such drawing(s):

Figure 21:
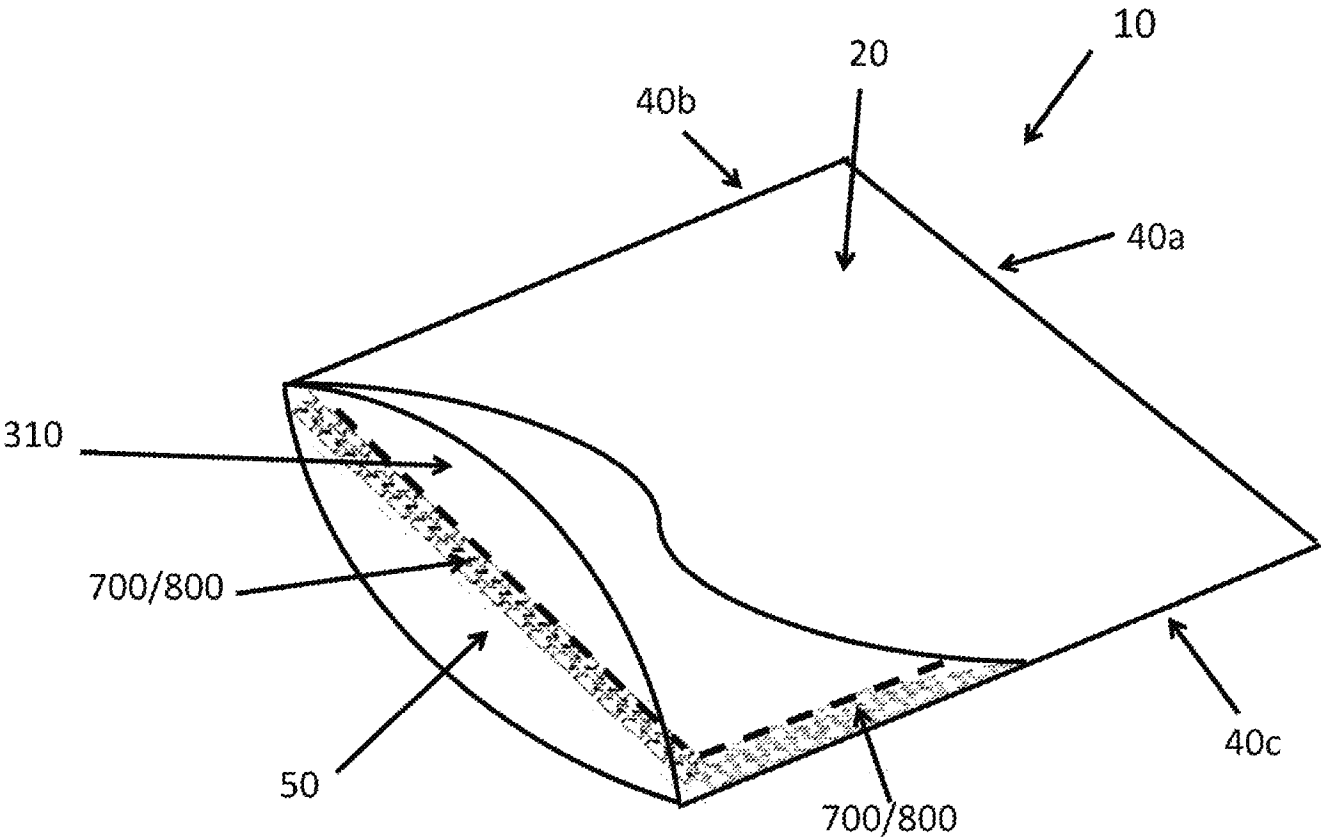

FIG. 21 an example embodiment of a hybrid view of both an interior and exterior of a duvet cover with fasteners attached to a comforter.

Figure 22:
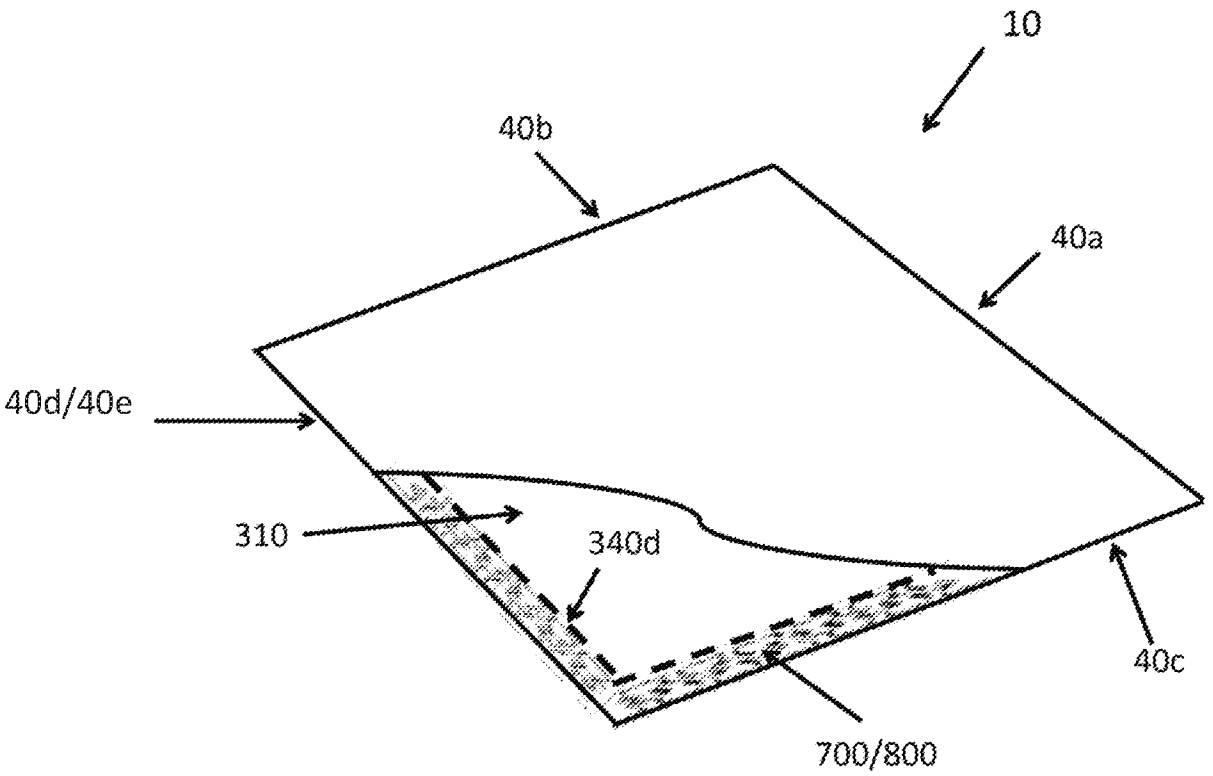

FIG. 22 is an example embodiment of a hybrid view comforter attached to a duvet cover interior using monolithic fasteners where the duvet cover is in a closed position.

Figure 23:
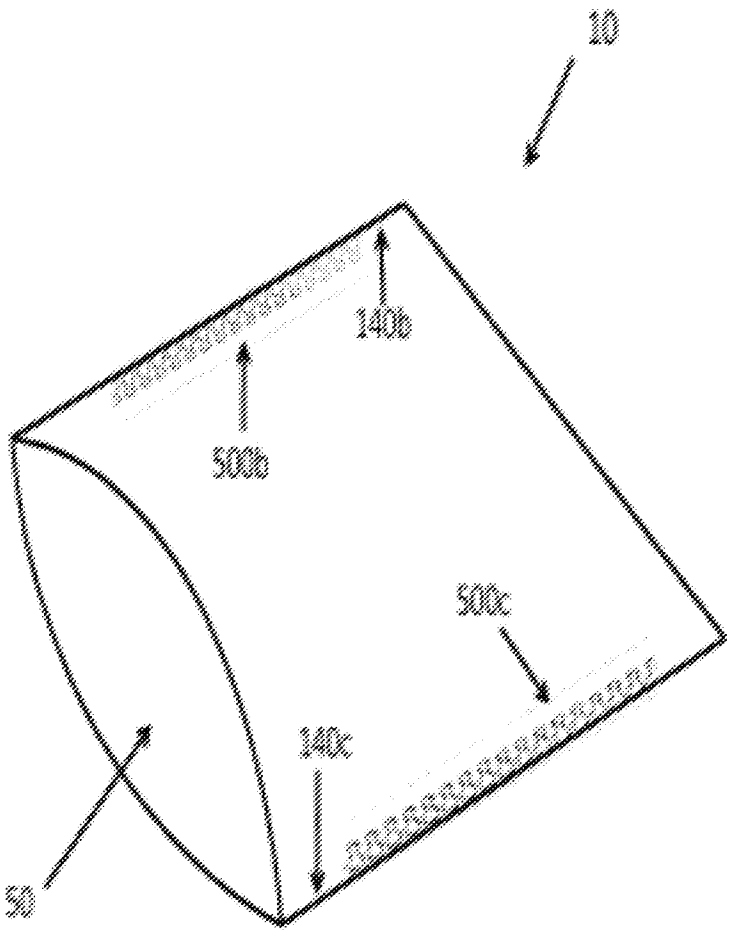

FIG. 23 is an example embodiment of a view of an interior of a duvet cover with two opposing fasteners.

Figure 24:
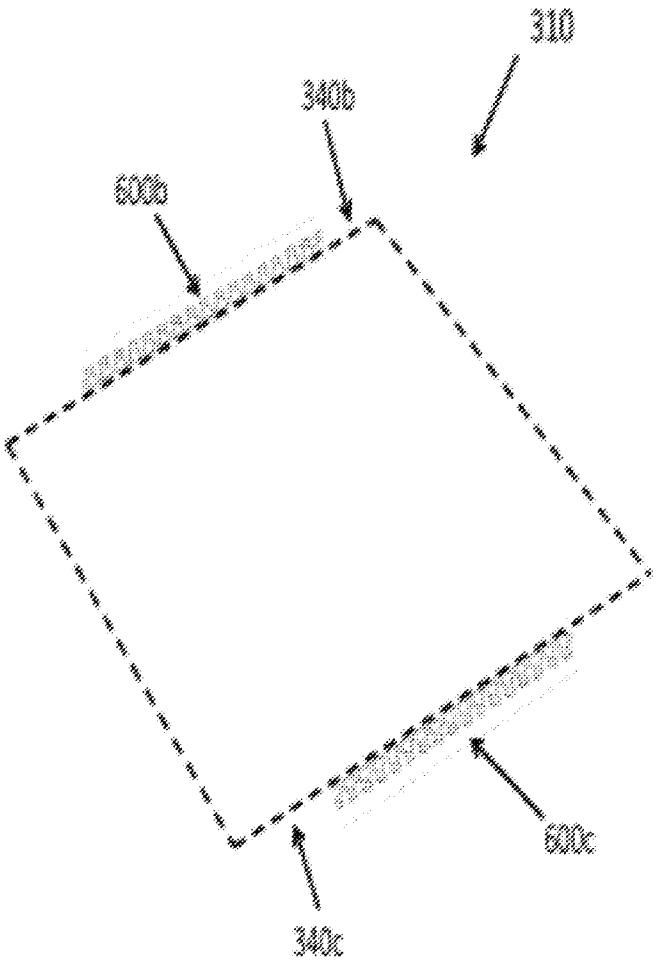

FIG. 24 is an example embodiment of a comforter with two side fasteners.

Figure 25:
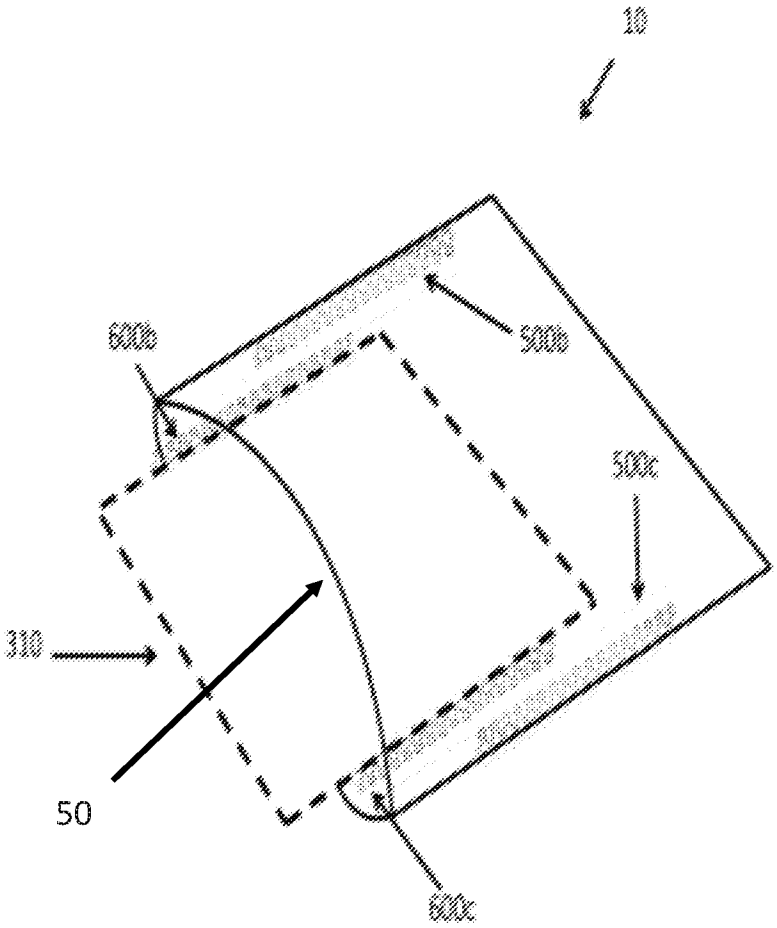

FIG. 25 is an example embodiment of a comforter partially inserted into an interior of a duvet cover.

Figure 26:
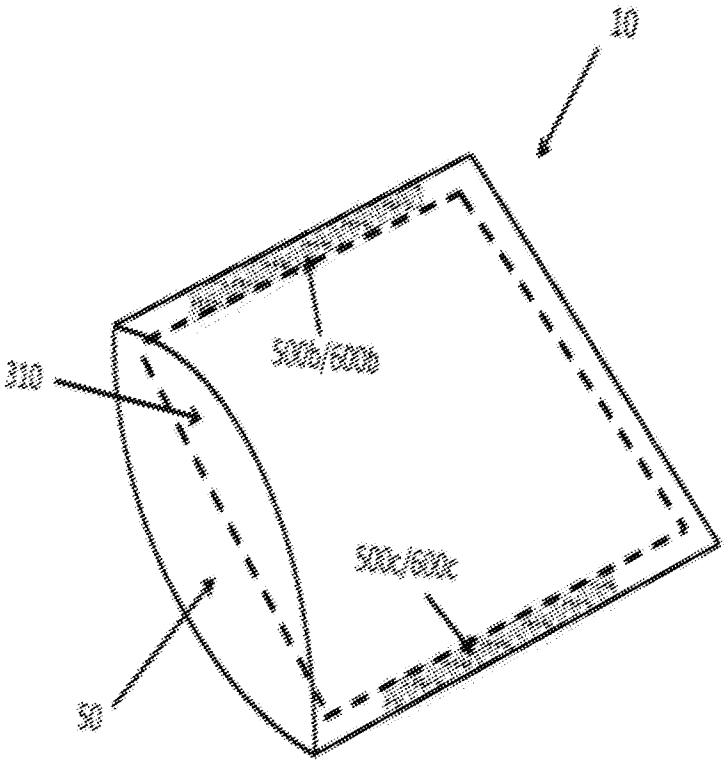

FIG. 26 is an example embodiment of a comforter with two side fasteners joined with a duvet cover with two opposing interior side fasteners.

Figure 27:
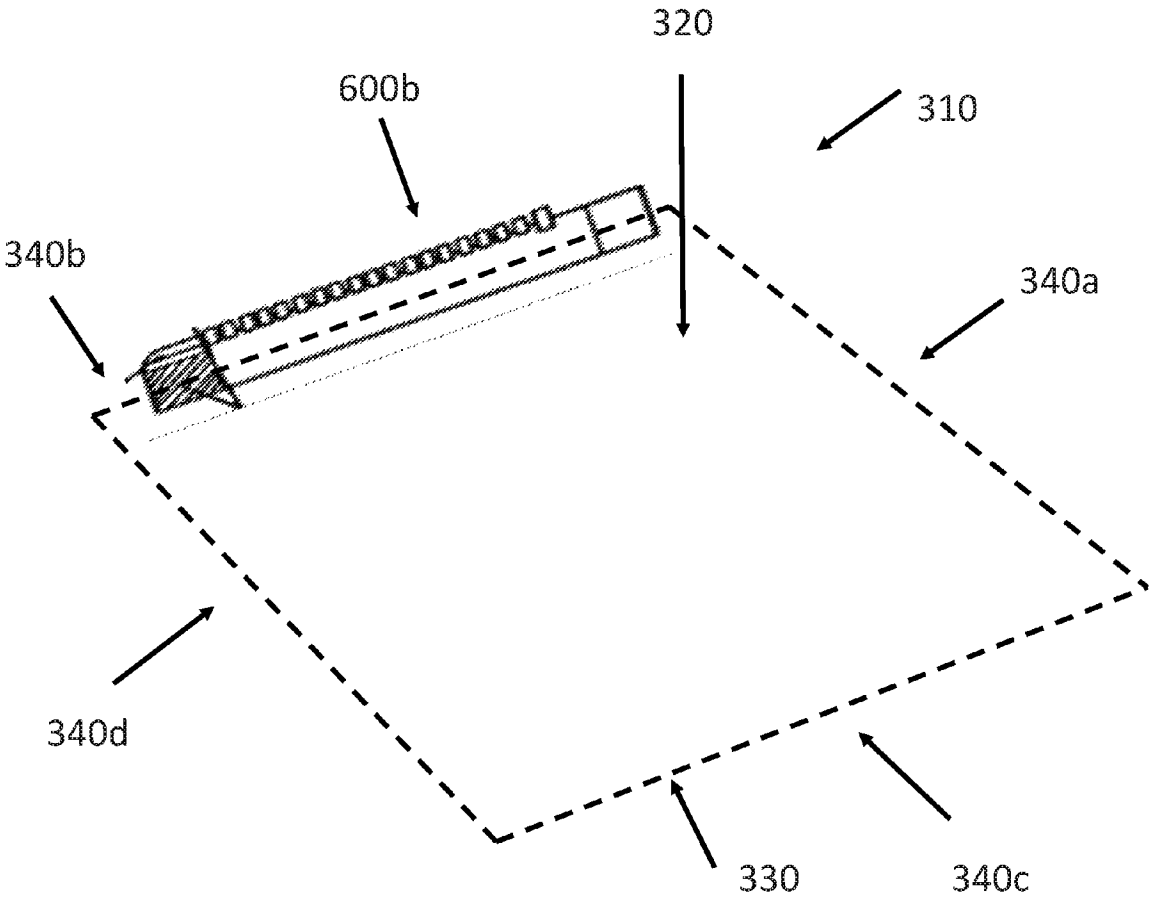

FIG. 27 is an example embodiment of a comforter with a comforter side fastener.

Figure 28:
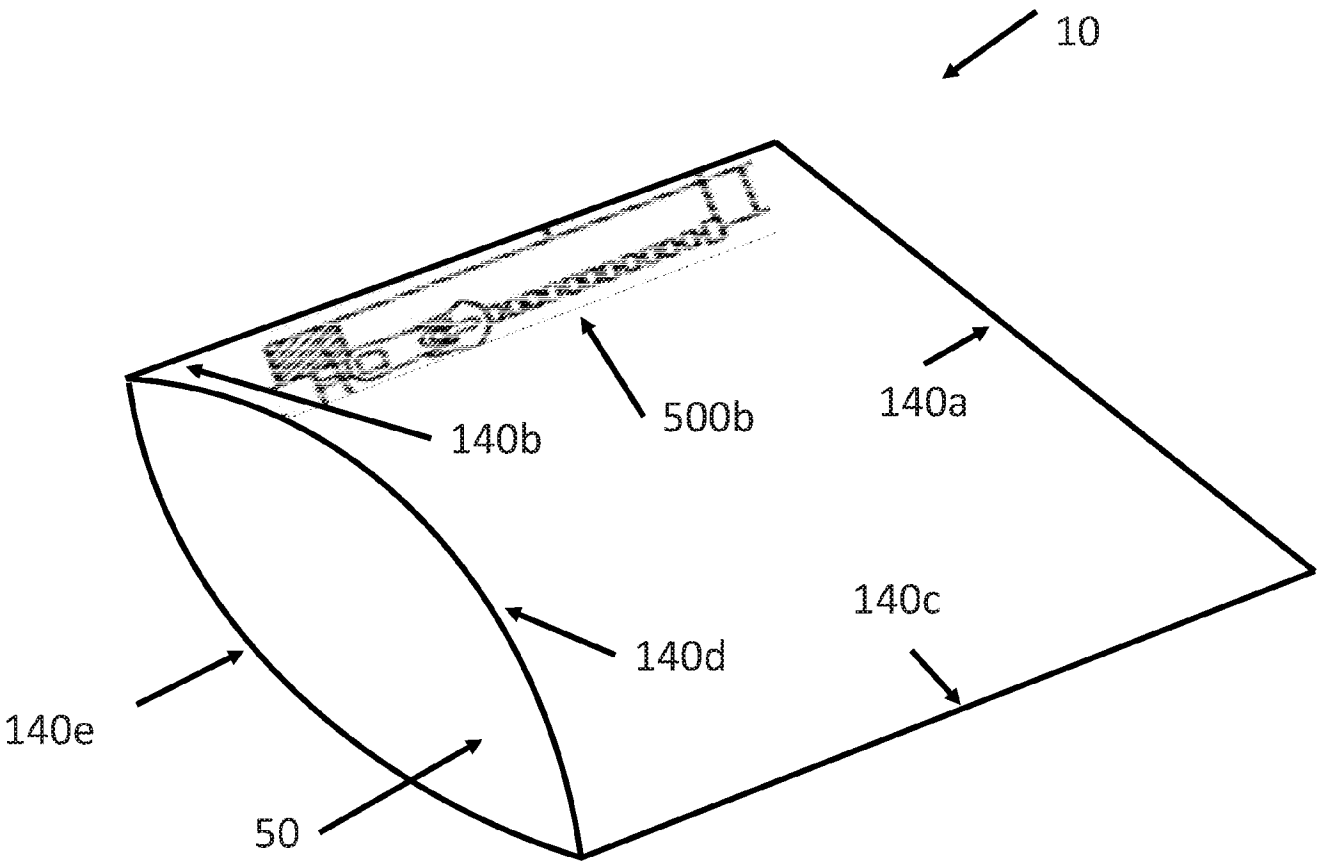

FIG. 28 is an example embodiment of a view of an interior of a duvet cover.

Figure 29:
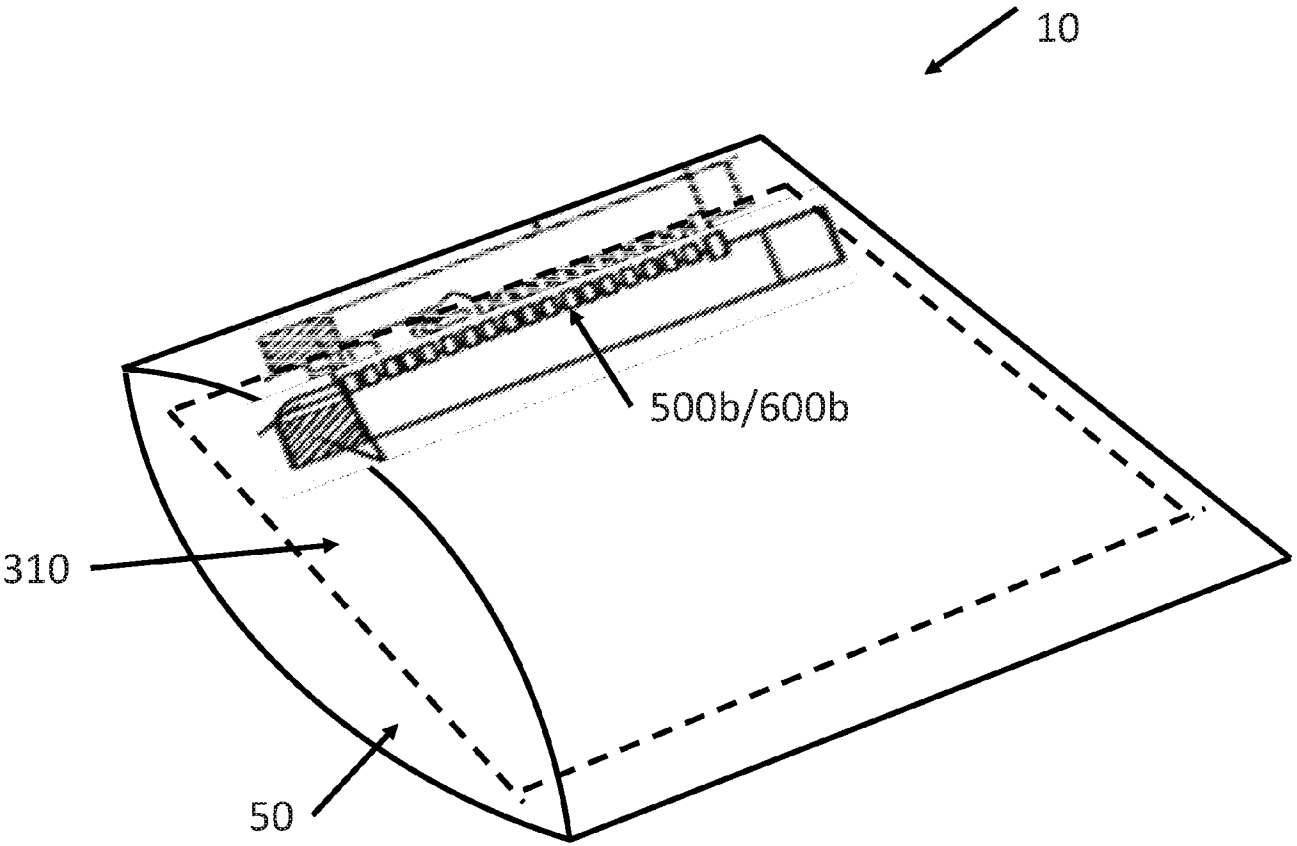

FIG. 29 is an example embodiment of a comforter connected to a duvet cover.

Figure 30:
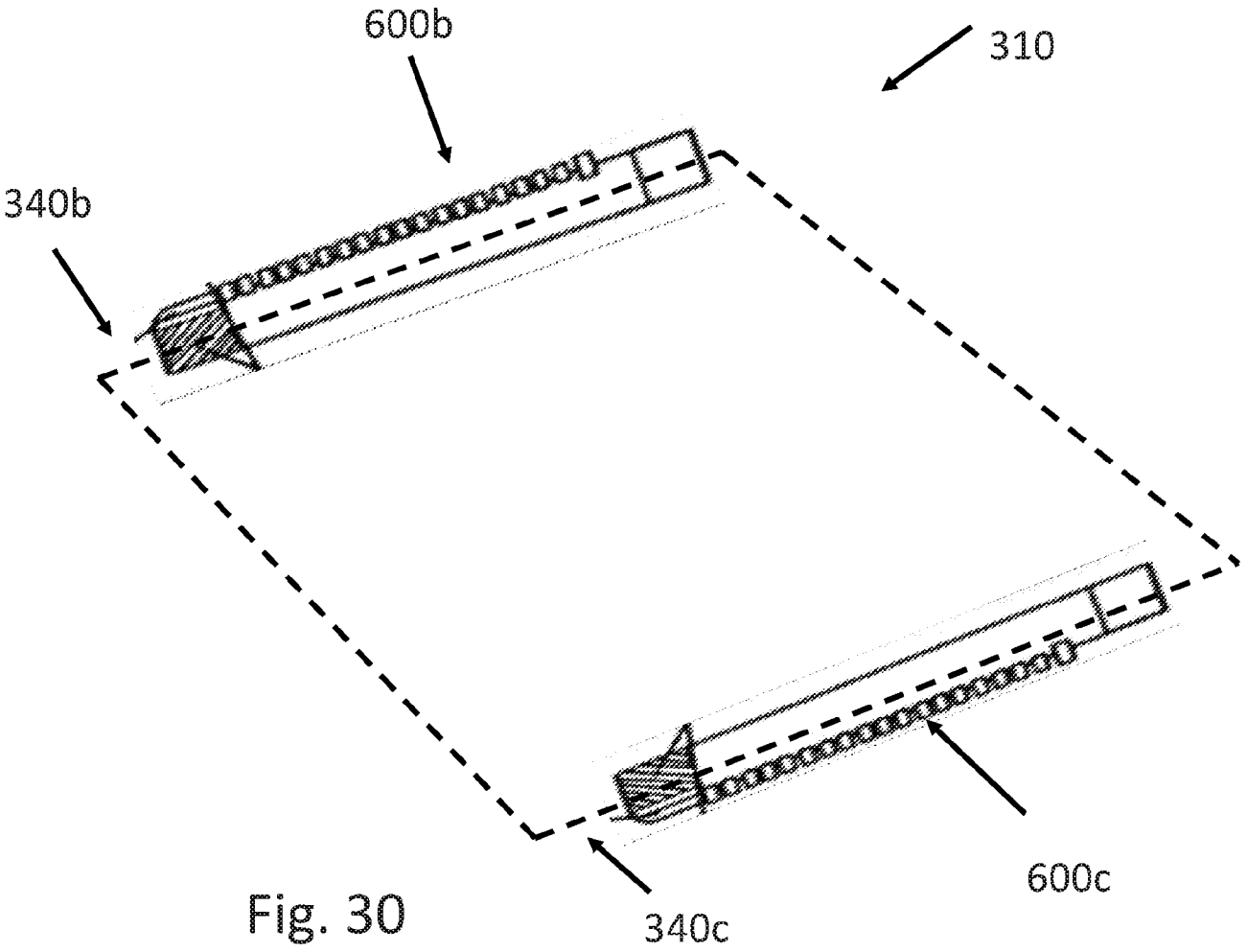

FIG. 30 is an example embodiment of a comforter with two side fasteners.

Figure 31:
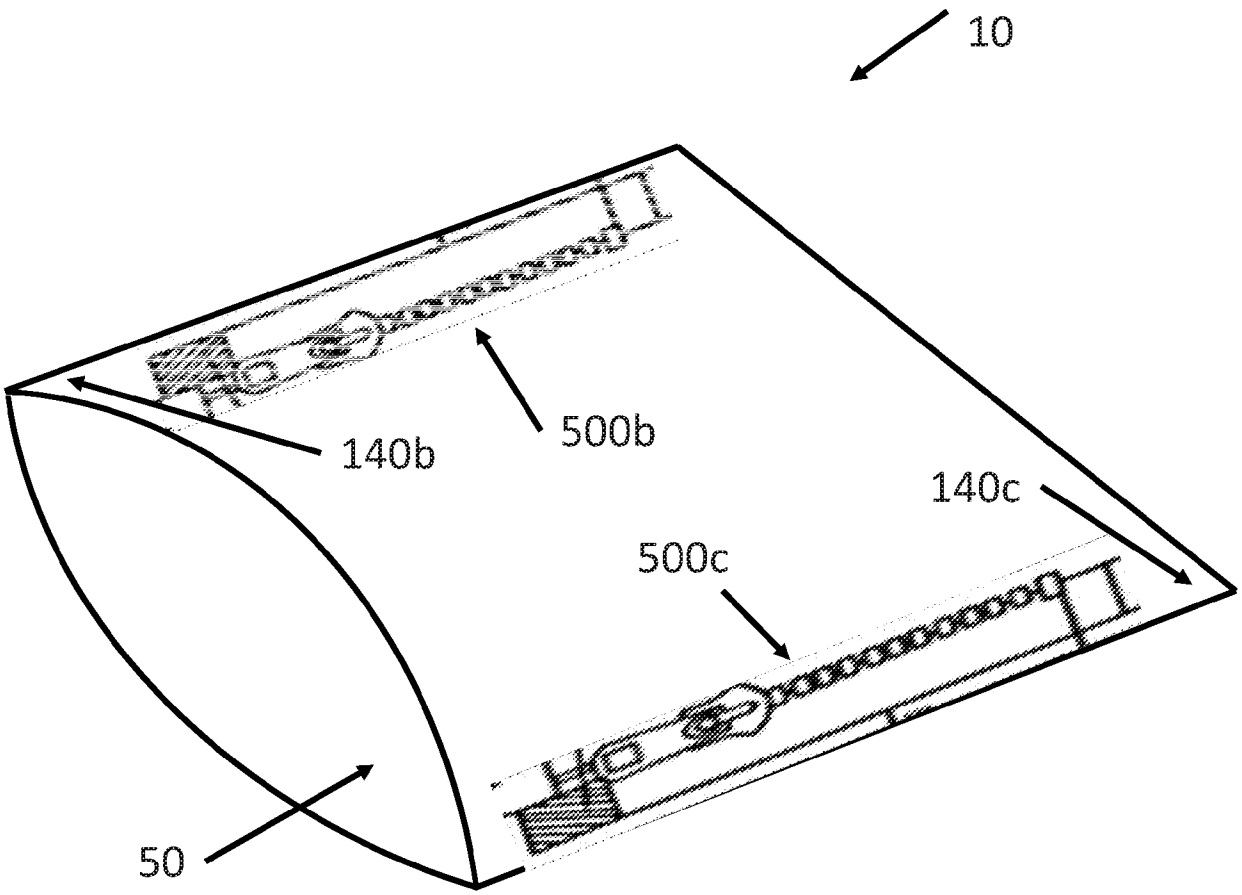

FIG. 31 is an example embodiment of a view of an interior of a duvet cover with two opposing fasteners.

Figure 32:
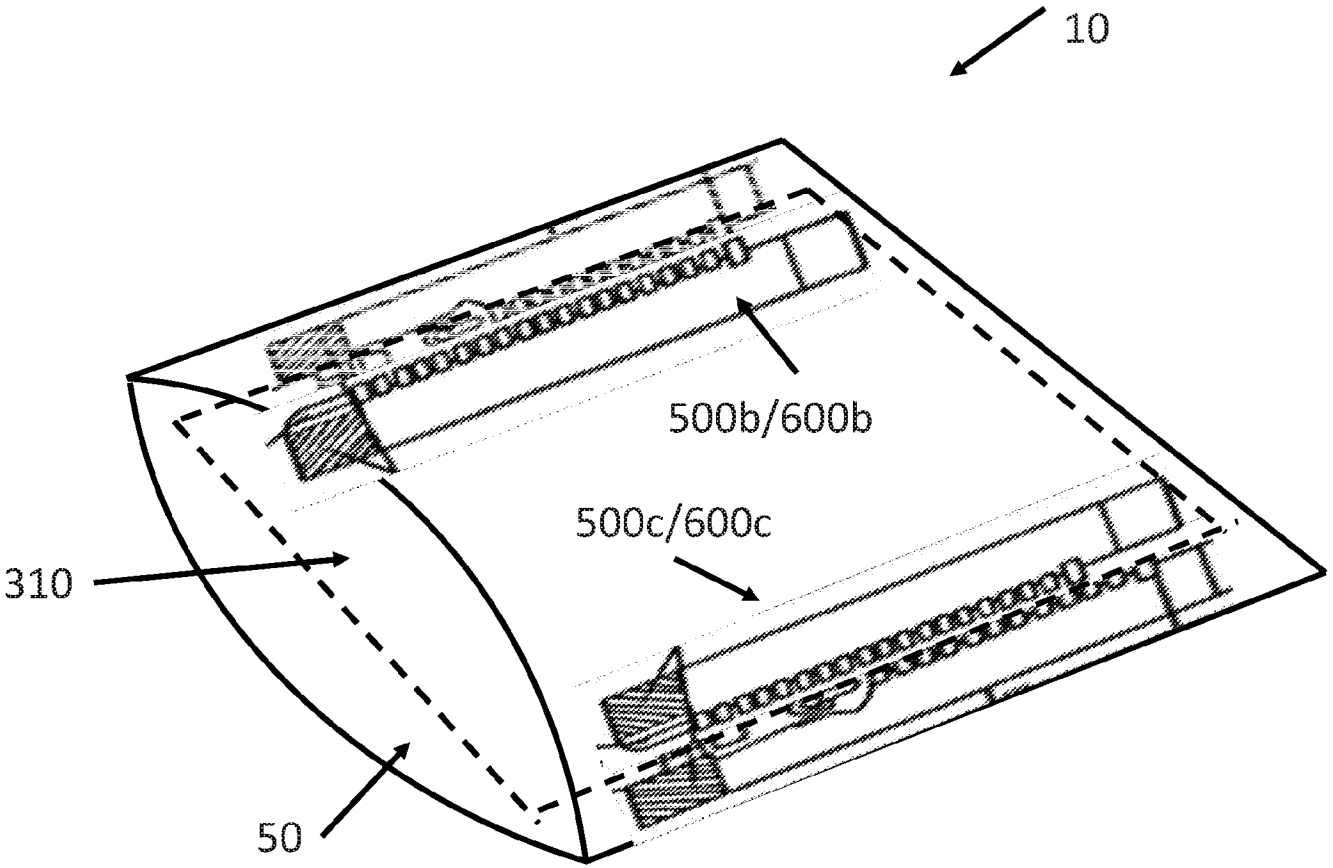

FIG. 32 is an example embodiment of a comforter with two side fasteners joined with a duvet cover with two opposing interior side fasteners.

DETAILED DESCRIPTION

Before the present subject matter is described in detail, it is to be understood that this disclosure is not limited to the particular embodiments described, as such may vary. It is also to be understood that the terminology used herein is for the purpose of describing particular embodiments only, and is not intended to be limiting, since the scope of the present disclosure will be limited only by the appended claims.

Provided herein are embodiments of devices, systems and methods for improved securing of duvet cover and comforters.

Figure 1:
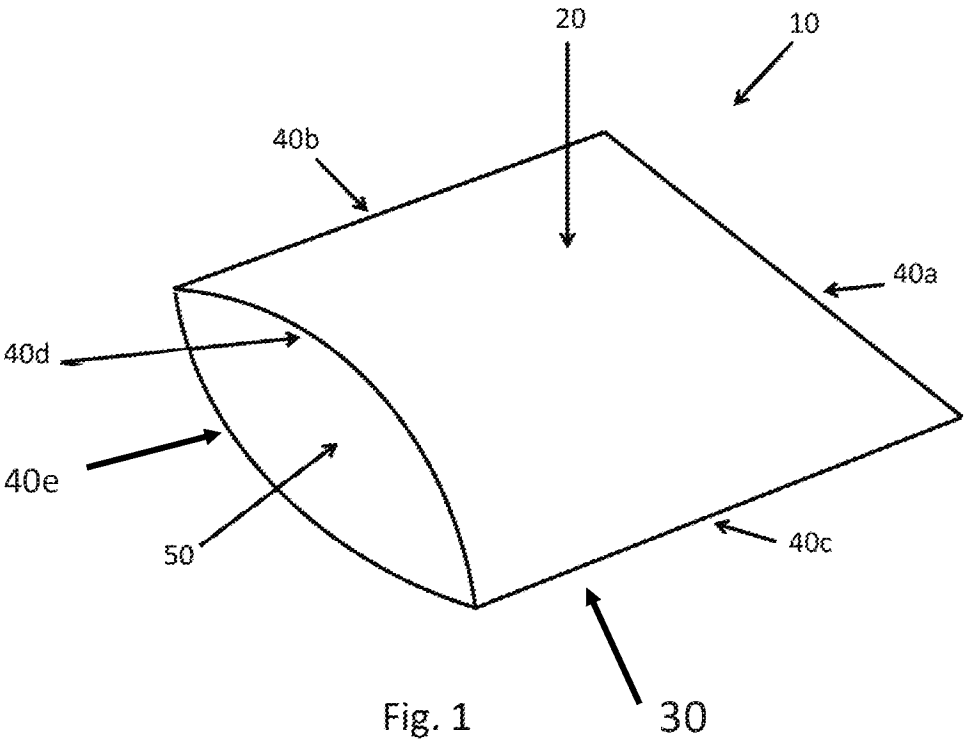
FIG. 1 is an example embodiment of a perspective view of an exterior view of a duvet cover.

FIG. 1 is an example embodiment of a perspective view of an exterior view of a duvet cover. As shown in FIG. 1, a duvet cover 10 can be used to cover and otherwise surround a comforter (e.g. see 310 in FIG. 6). It can also connect or otherwise couple to the comforter in various embodiments. Duvet cover 10 can have an exterior top 20 having exterior back side 40*a*, exterior left side 40*b*, exterior right side 40*c* and exterior front upper side 40*d*. Hidden from view is a duvet cover exterior bottom 30, defined by exterior back side 40*a*, exterior left side 40*b*, exterior right side 40*c* and exterior front lower side 40*e*. Exterior front upper side 40*d* and exterior front lower side 40*e* can form a duvet cover opening 50 and can be an opening through which a comforter (e.g. see 310 in FIG. 6) is inserted.

Figure 2:
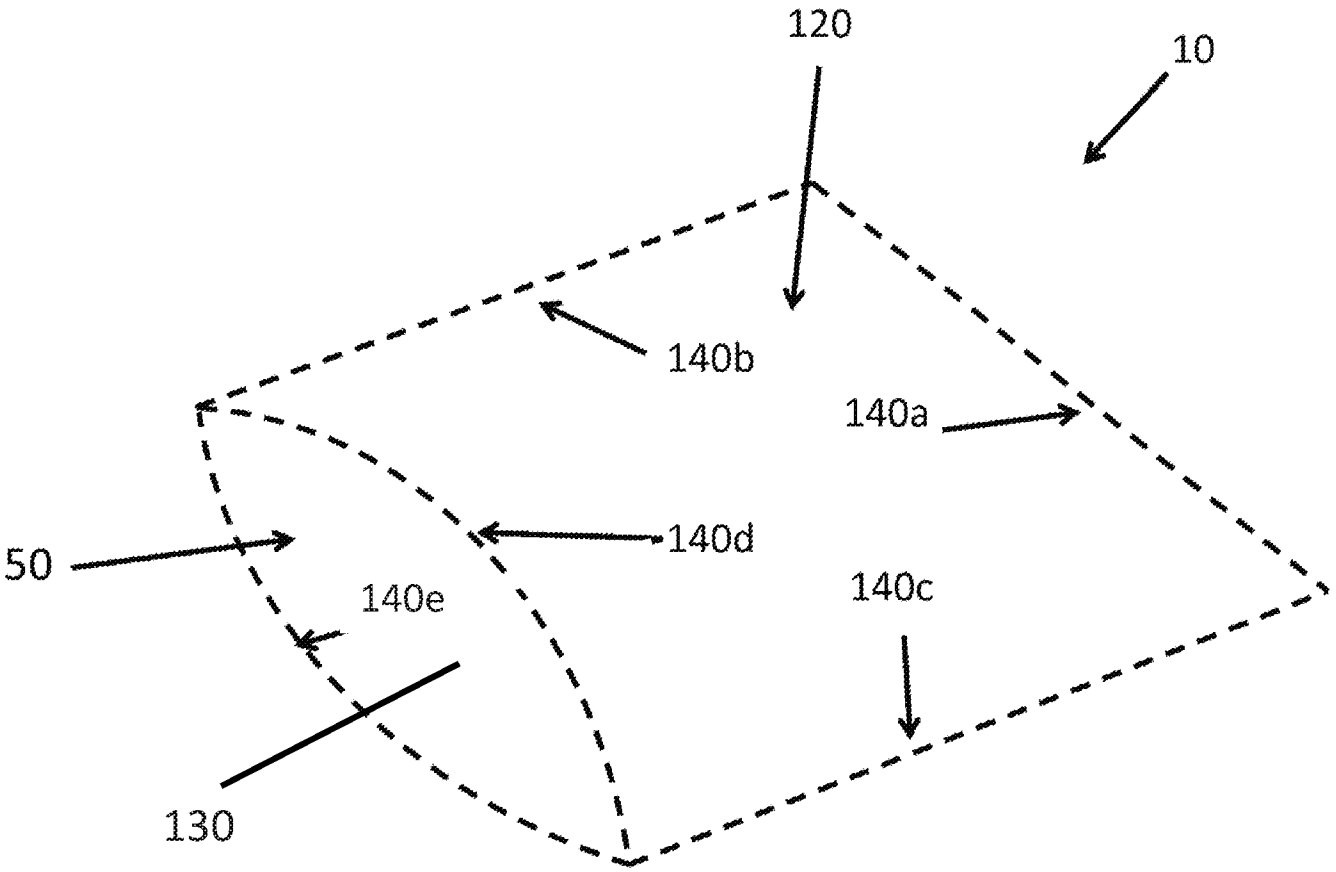
FIG. 2 is an example embodiment of a view of the interior of a duvet cover.

FIG. 2 is an example embodiment of a view of the interior of a duvet cover. Here, duvet cover 10 show in broken lines includes a duvet cover interior top 120 and duvet cover interior back side 140*a*, interior left side 140*b*, interior right side 140*c*, interior front upper side 140*d* and interior front lower side 140*e*. These interior sides can be analogous to exterior sides 40*a*, 40*b*, 40*c*, 40*d* and 40*e* respectively. Duvet cover interior top 120 (see through view) can be defined by duvet cover interior back side 140*a*, interior left side 140*b*, interior right side 140*c*, interior front upper side 140*d* and can be analogous to exterior top 20. The interior of duvet cover 10 can be accessed through duvet cover opening 50 which exists between upper and lower interior sides 140*d* and 140*e* respectively. Duvet cover interior bottom 130 can be defined by duvet cover interior back side 140*a*, interior left side 140*b*, interior right side 140*c*, and interior front lower side 140*e* and can be analogous to duvet cover exterior bottom 30.

Figure 3:
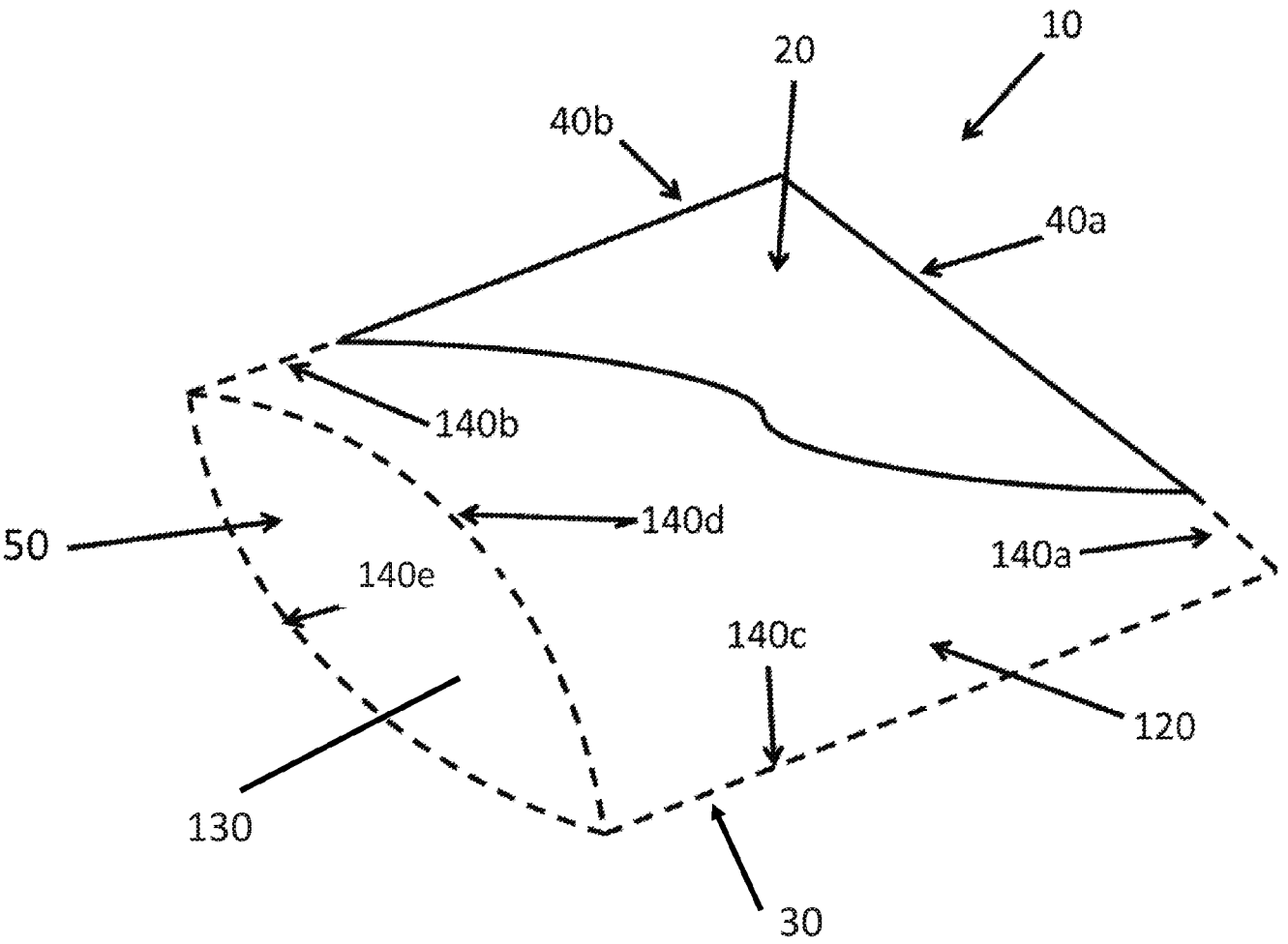
FIG. 3 is an example embodiment of a hybrid view of both an interior and exterior view of a duvet cover.

FIG. 3 is an example embodiment of a hybrid view of both an interior and exterior view of a duvet cover. As shown in FIG. 3, most elements described above with respect to FIGS. 1 and 2 can be seen in a single diagram.

Figure 4:
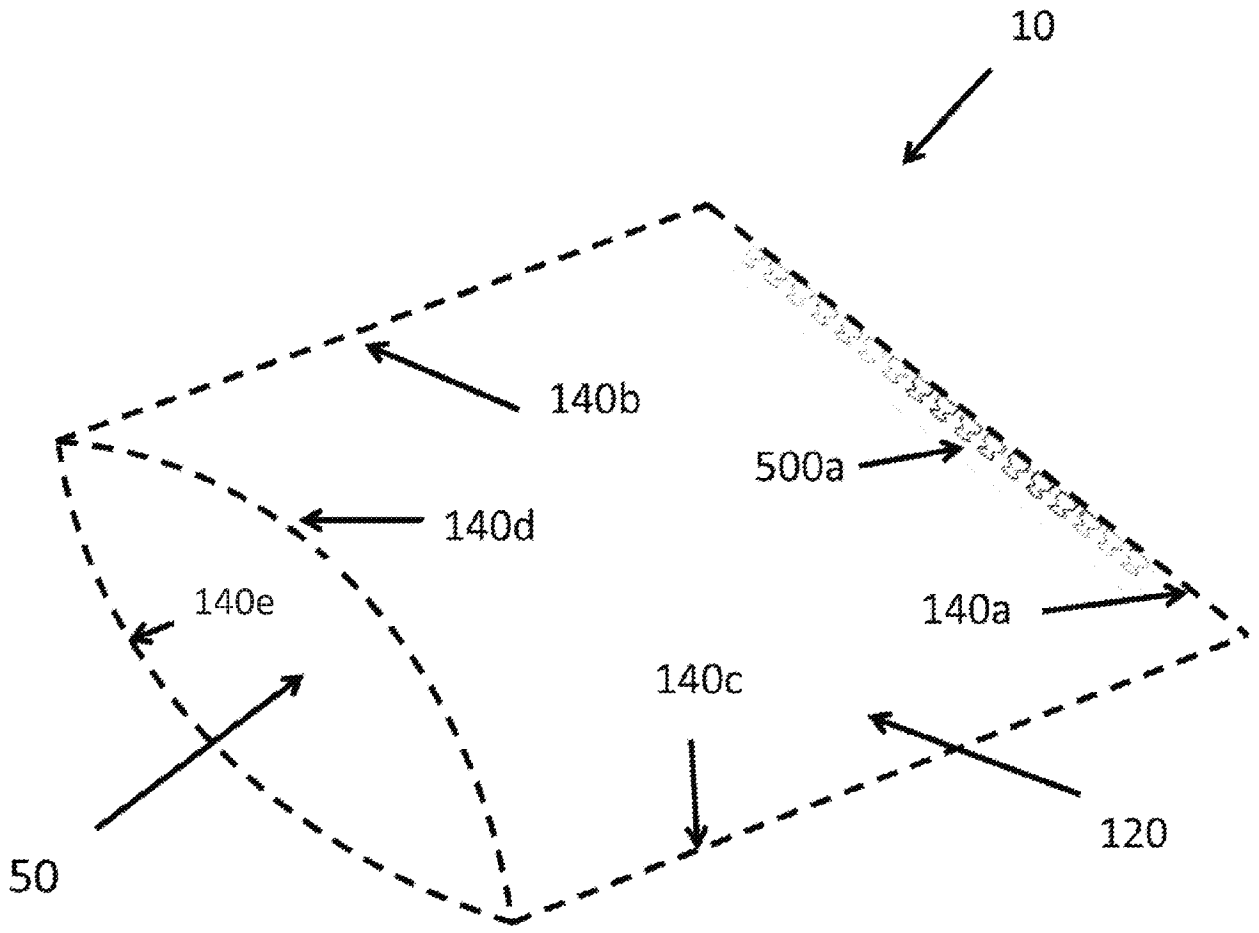
FIG. 4 is an example embodiment of a view of an interior of a duvet cover.

FIG. 4 is an example embodiment of a view of an interior of a duvet cover. In the example embodiment, duvet cover 10 (shown in broken lines) includes an interior side fastener 500*a* which can connect or otherwise couple to a comforter side fastener (e.g. see 600*a* of FIG. 7). Fastener 500*a* can be affixed along part or a whole of a duvet side by various means. In the example embodiment, it is permanently affixed during a manufacturing process by being sewn into duvet cover 10 along interior side 140*a*. In some embodiments, this can include sewing fastener 500*a* between duvet cover interior bottom (e.g. see 130 of FIG. 2) and duvet cover interior top (e.g. see 120 of FIG. 2).

Figure 5:
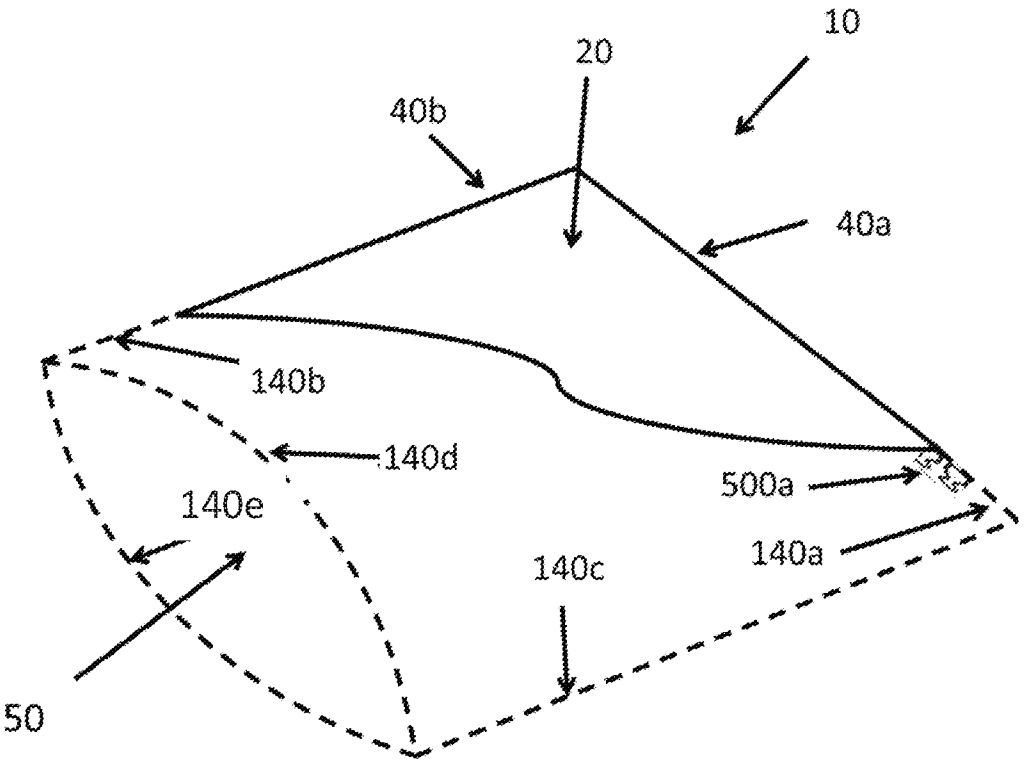
FIG. 5 is an example embodiment of a hybrid view of both an interior and exterior view of a duvet cover with a fastener included.

FIG. 5 is an example embodiment of a hybrid view of both an interior and exterior view of a duvet cover with a fastener 500*a* included.

Figure 6:
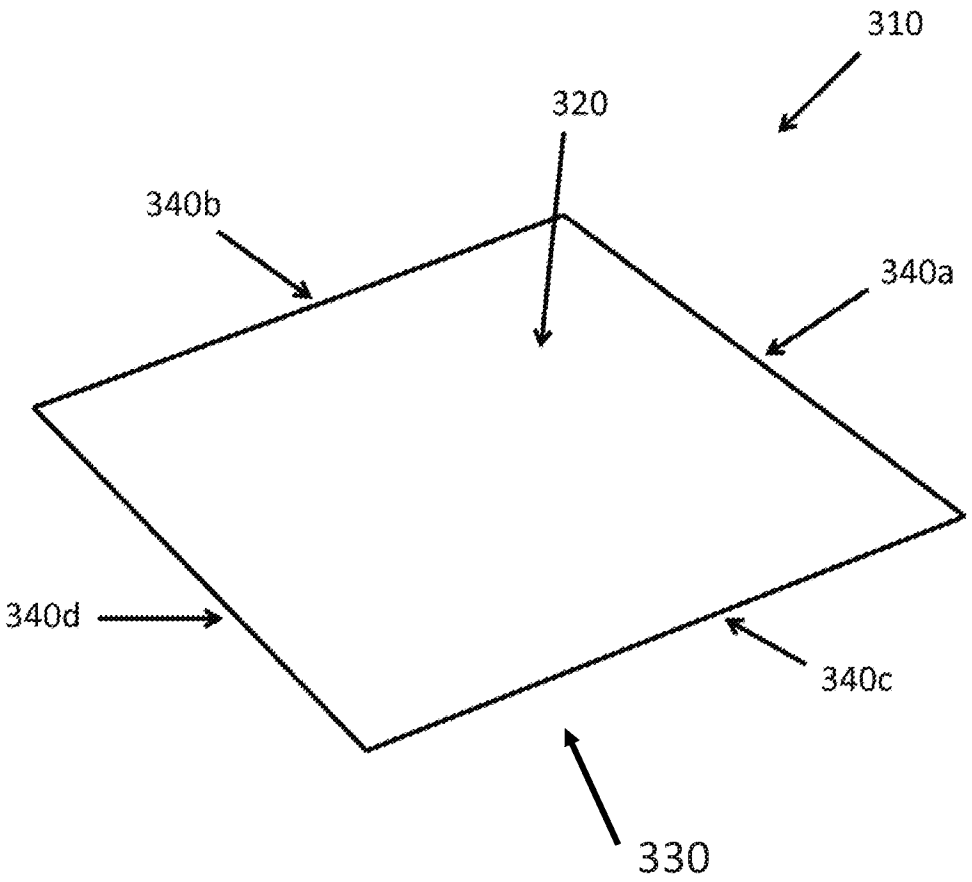
FIG. 6 is an example embodiment of a comforter.

FIG. 6 is an example embodiment of a comforter. In the example embodiment, comforter 310 can be inserted into a duvet cover (e.g. see 10 of FIG. 1). Comforter 310 can include a comforter top 320 defined by comforter back side 340*a*, left side 340*b*, right side 340*c*, and front side 340*d*. Hidden from view is a comforter bottom 330, similarly defined by 340*a*, 340*b*, 340*c* and 340*d* and analogous to 320.

Figure 7:
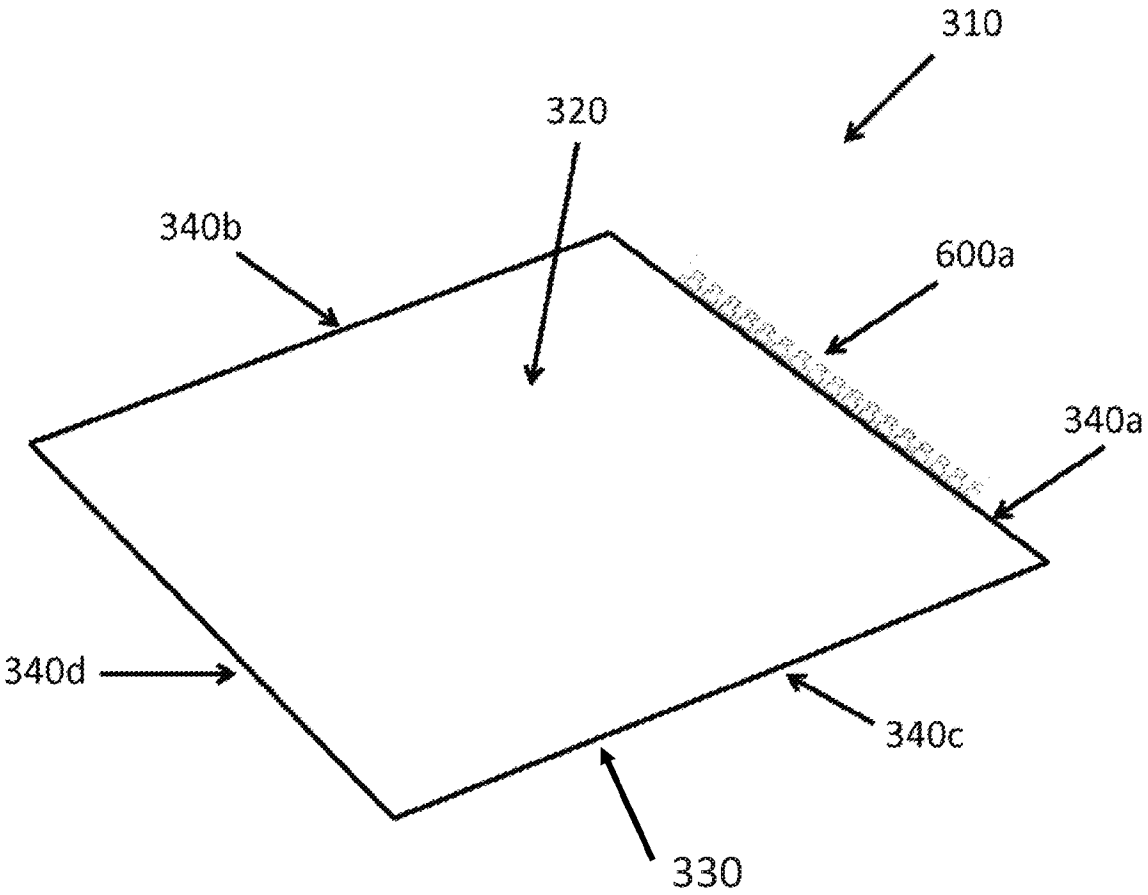
FIG. 7 is an example embodiment of a comforter with a comforter side fastener.

FIG. 7 is an example embodiment of a comforter with a comforter side fastener. In the example embodiment, comforter 310 includes a comforter side fastener 600*a* attached to comforter side 340*a*. Comforter side fastener 600*a* can be affixed or otherwise attached along part or a whole of a comforter side by various means. In the example embodiment, it is affixed during a manufacturing process by being sewn to comforter 310 along comforter side 340*a*. Comforter side fasteners 600*a* can connect or otherwise couple comforter 310 to a duvet cover interior side fastener (e.g. see 500*a* of FIG. 4). In some embodiments, this can include sewing fastener 600*a* between comforter bottom 330 and comforter top 320.

Figure 8:
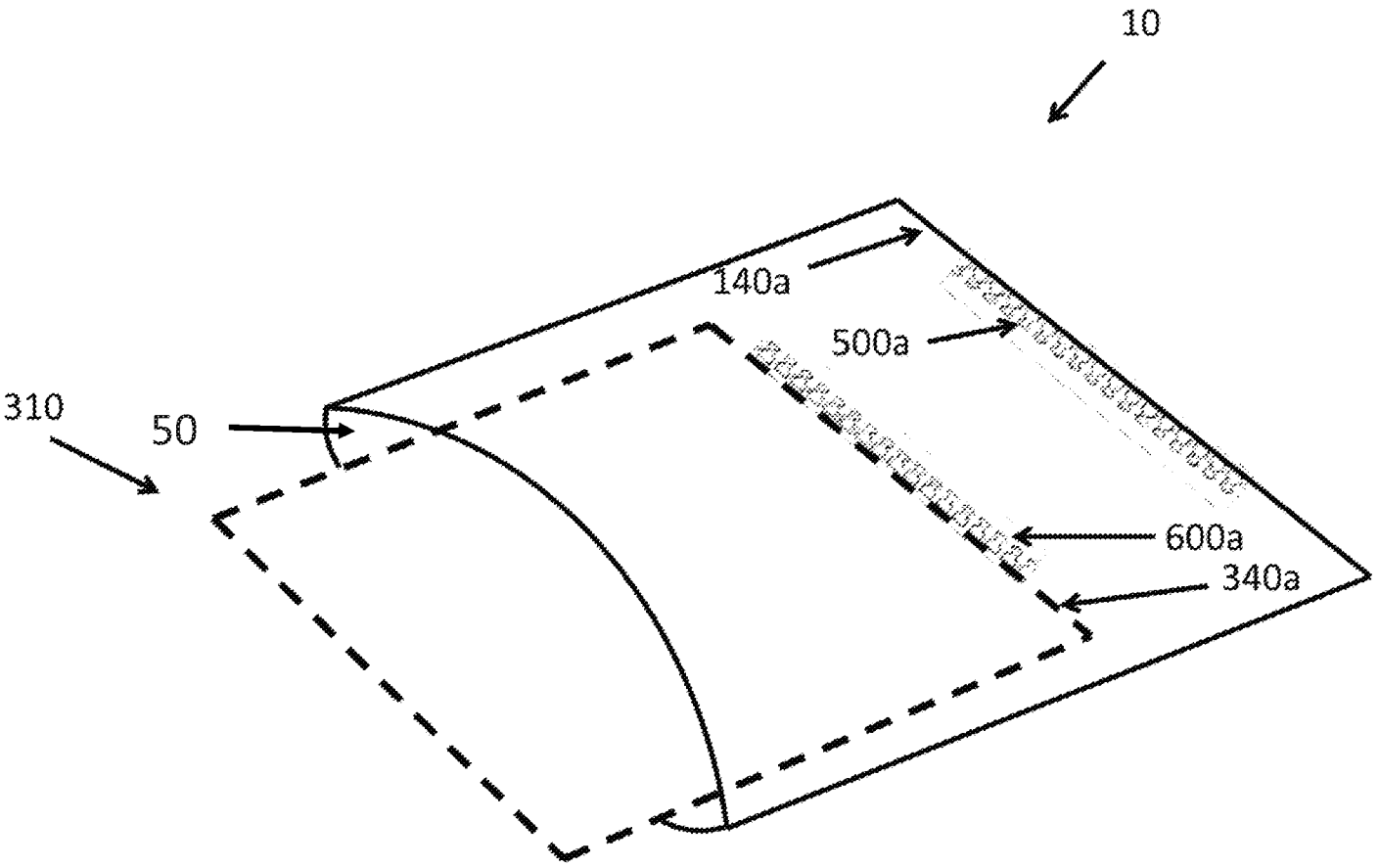
FIG. 8 is an example embodiment of a comforter partially inserted into a duvet cover.

FIG. 8 is an example embodiment of a comforter partially inserted into a duvet cover. In the example embodiment, comforter 310 (shown in broken lines) is inserted partially into duvet cover 10 through opening 50. Duvet cover interior side fastener 500*a* can connect or otherwise couple with comforter side fastener 600*a* in order to permanently or removably couple comforter 310 with duvet cover 10.

Figure 9:
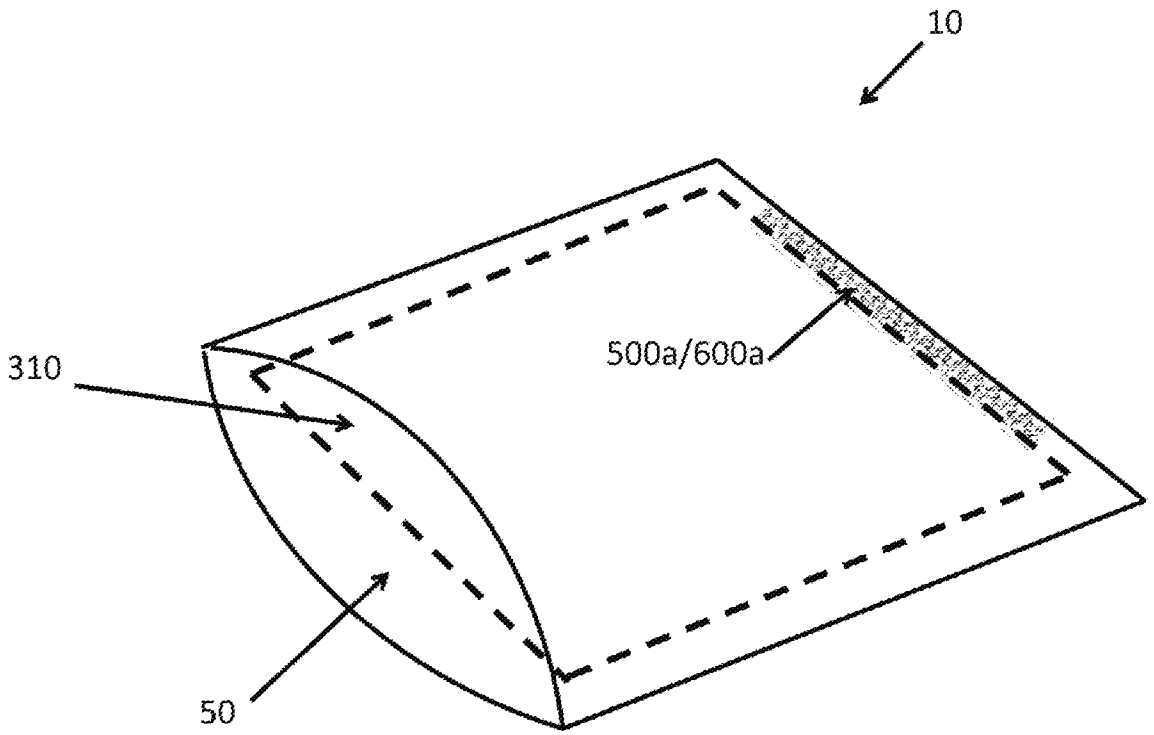
FIG. 9 is an example embodiment of a comforter connected to a duvet cover.

FIG. 9 is an example embodiment of a comforter connected to a duvet cover. In the example embodiment, comforter 310 (shown in broken line) is connected or otherwise coupled to duvet cover 10 by joining comforter side fastener 600*a* to duvet cover interior side fastener 500*a*. In attached position, comforter 310 is preferably fully within duvet cover 10 such that it does not extend through opening 50.

Figure 10:
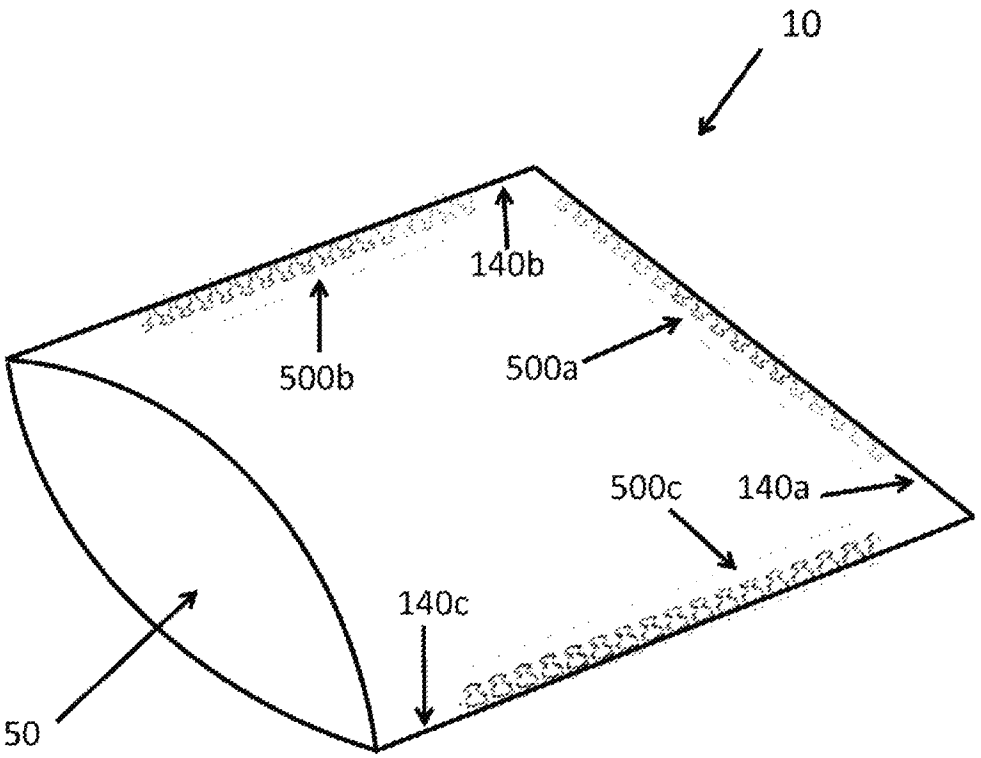
FIG. 10 is an example embodiment of a view of the interior of a duvet cover with multiple interior side fasteners.

FIG. 10 is an example embodiment of a view of the interior of a duvet cover with multiple interior side fasteners. In the example embodiment, duvet cover 10 includes three duvet cover interior side fasteners 500*a*, 500*b* and 500*c* attached respectively to interior back side 140*a*, interior left side 140*b* and interior left side 140*c*. In the example embodiment, the interior side fasteners 500*a*, 500*b* and 500*c* are not coupled to one another.

Figure 11:
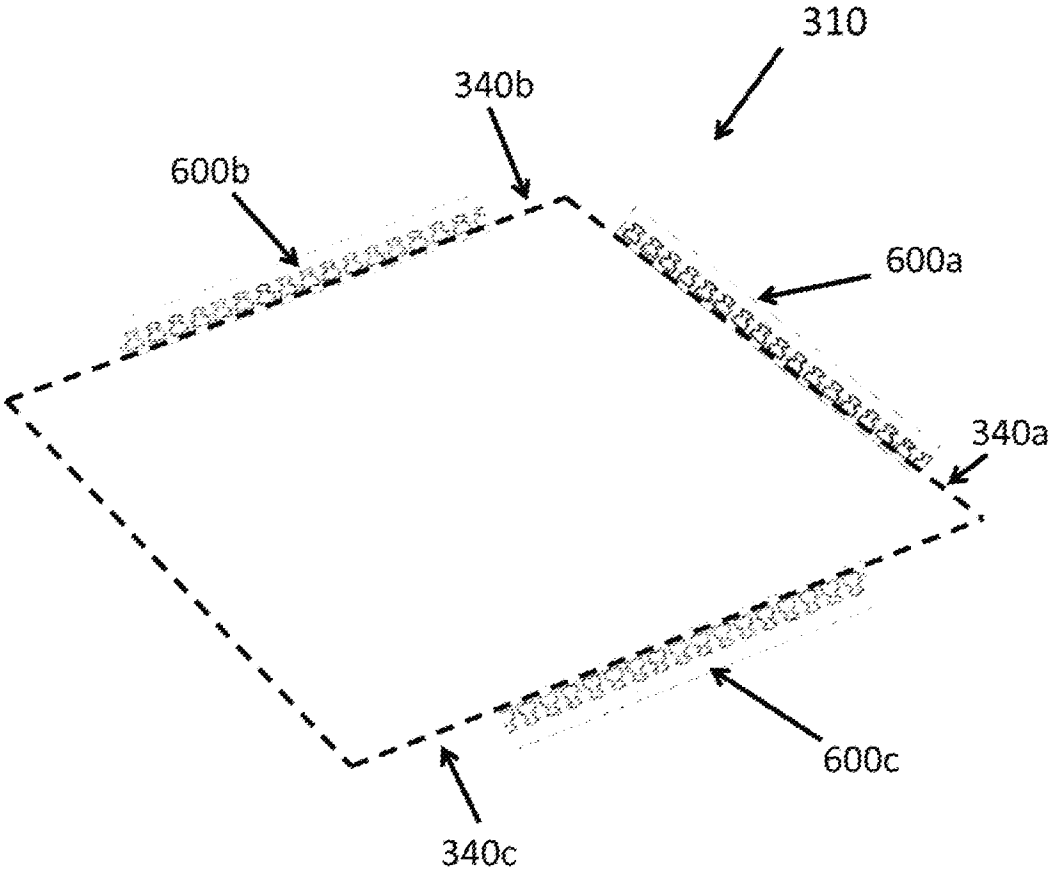
FIG. 11 is an example embodiment of a comforter with multiple comforter side fasteners.

FIG. 11 is an example embodiment of a comforter with multiple comforter side fasteners. In the example embodiment, comforter 310 (shown in broken lines) includes three comforter side fasteners 600*a*, 600*b* and 600*c* attached respectively to comforter back side 340*a*, comforter left side 340*b* and comforter right side 340*c*. In the example embodiment, the comforter side fasteners 600*a*, 600*b* and 600*c* are not coupled to one another.

Figure 12:
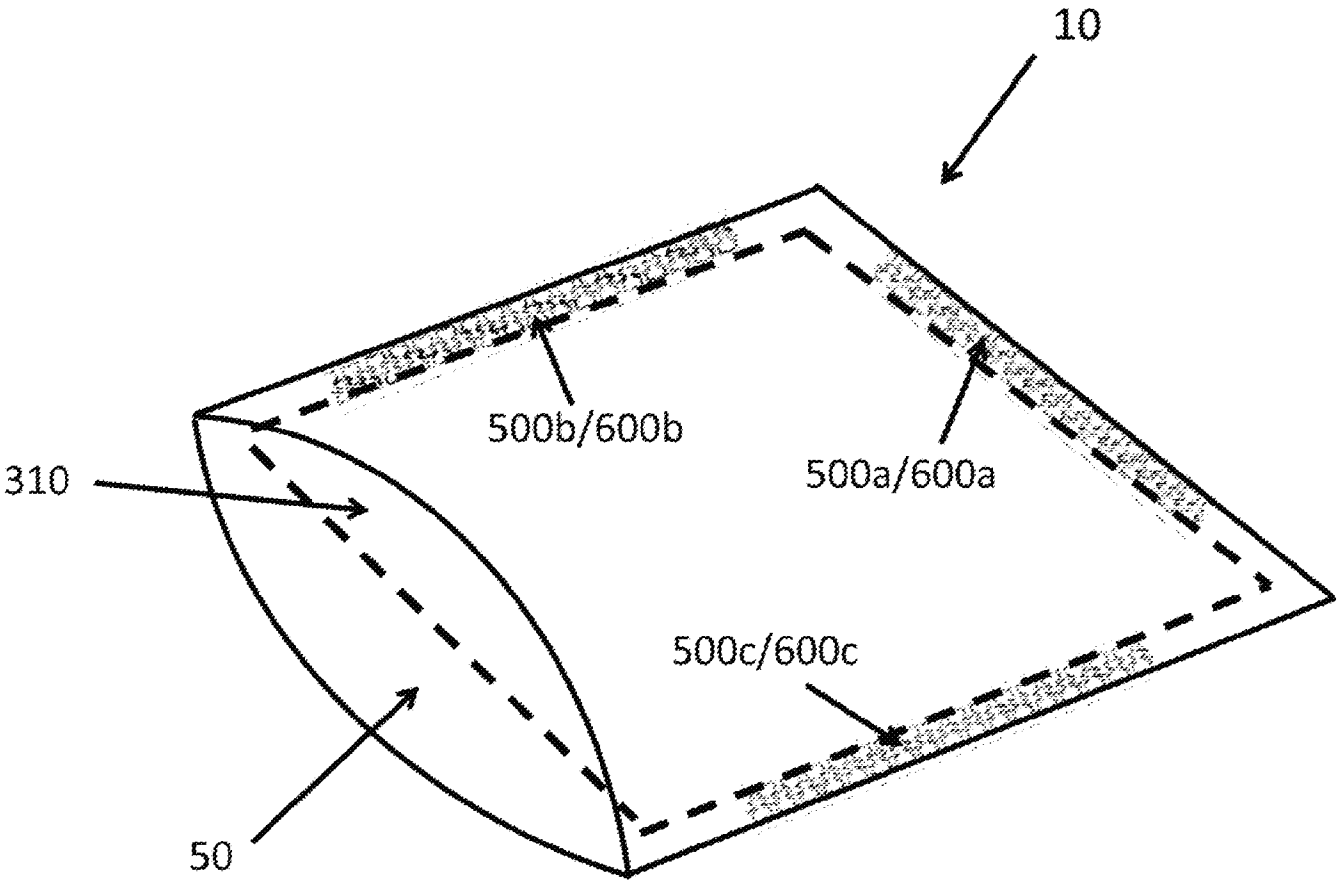
FIG. 12 is an example embodiment of a comforter connected to an interior of a duvet cover.

FIG. 12 is an example embodiment of a comforter connected to an interior of a duvet cover. In the example embodiment, comforter 310 (shown in broken lines) with side fasteners 600*a*, 600*b* and 600*c* is inserted through opening 50 and connected or otherwise coupled to the interior of duvet cover 10 (having fasteners 500*a*, 500*b* and 500*c*) by joining fasteners 500*a* to 600*a*, 500*b* to 600*b*, and 500*c* to 600*c*.

Figure 13:
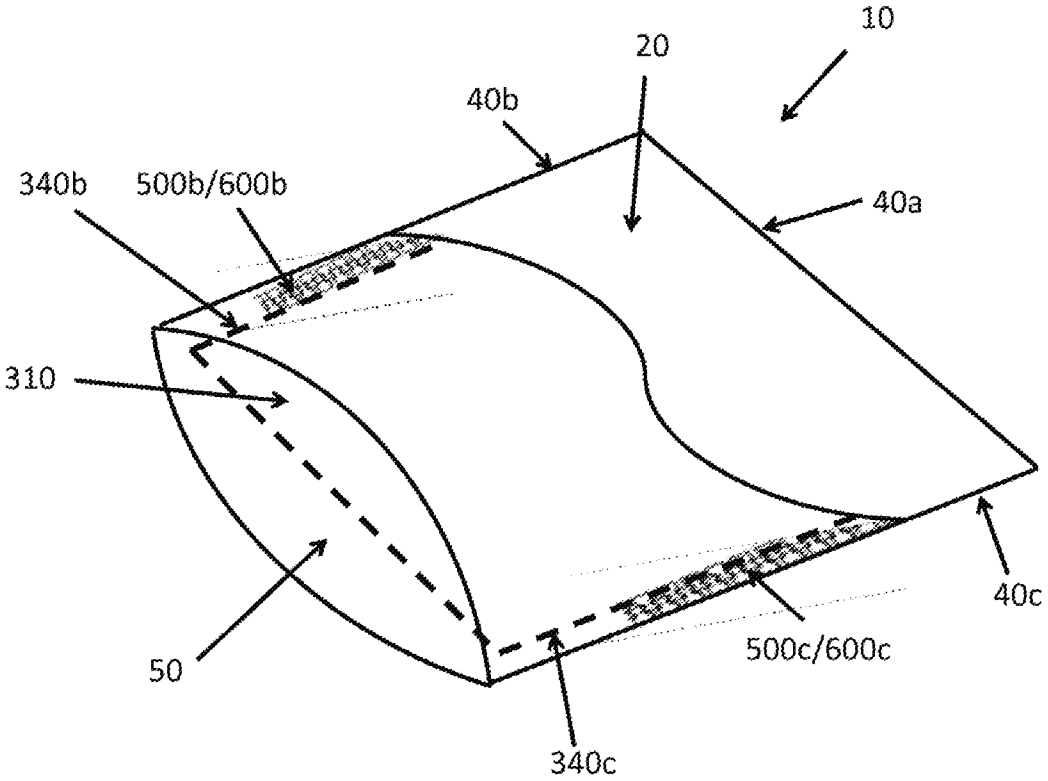
FIG. 13 is an example embodiment of a hybrid view of both an interior and exterior of a duvet cover with fasteners attached to a comforter.

FIG. 13 is an example embodiment of a hybrid view of both an interior and exterior of a duvet cover with fasteners attached to a comforter. As shown, various elements of FIGS. 10-12 are shown.

Figure 14:
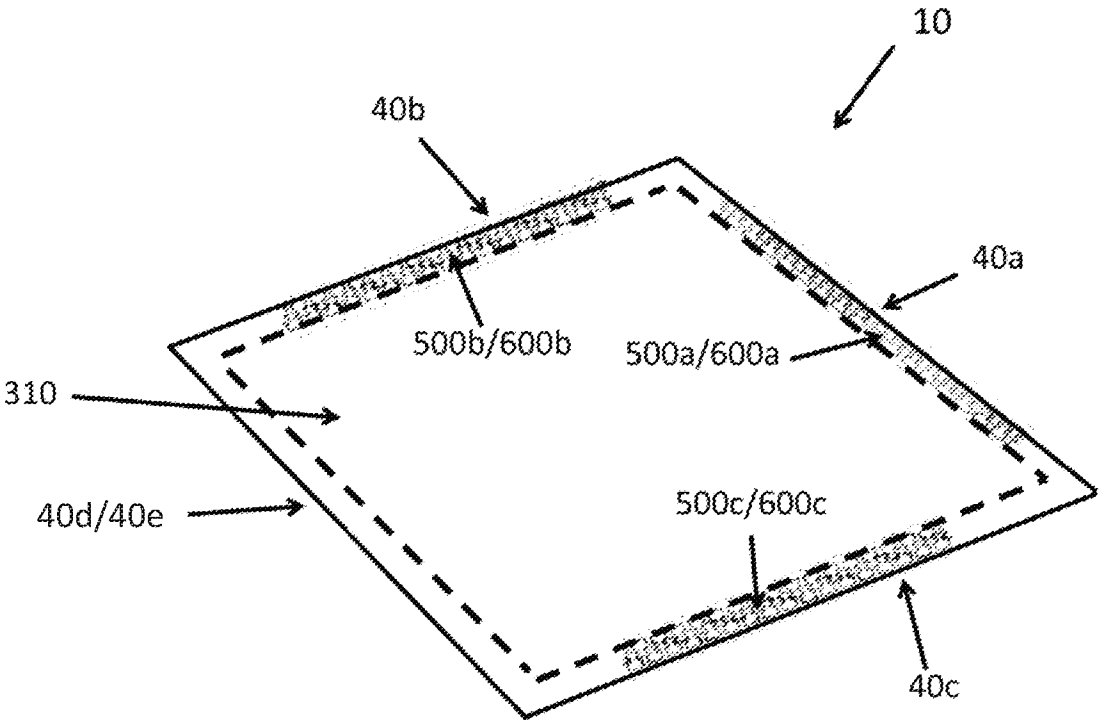
FIG. 14 is an example embodiment of a comforter attached to a duvet cover in a closed formation.

FIG. 14 is an example embodiment of a comforter attached or otherwise coupled to a duvet cover in a closed formation. In the example embodiment, comforter 310 (shown in broken lines) is connected or otherwise coupled to duvet cover 10 by attaching fasteners as previously described with respect to FIGS. 12-13. Here, duvet cover exterior side 40*d* and 40*e* are in a closed position. In some embodiments, this can include a coupling mechanism or feature that joins or otherwise holds 40*d* and 40*e* together with respect to each other by maintaining an interior connection of interior front sides 140*d* and 140*e* (not shown) respectively.

Figure 15:
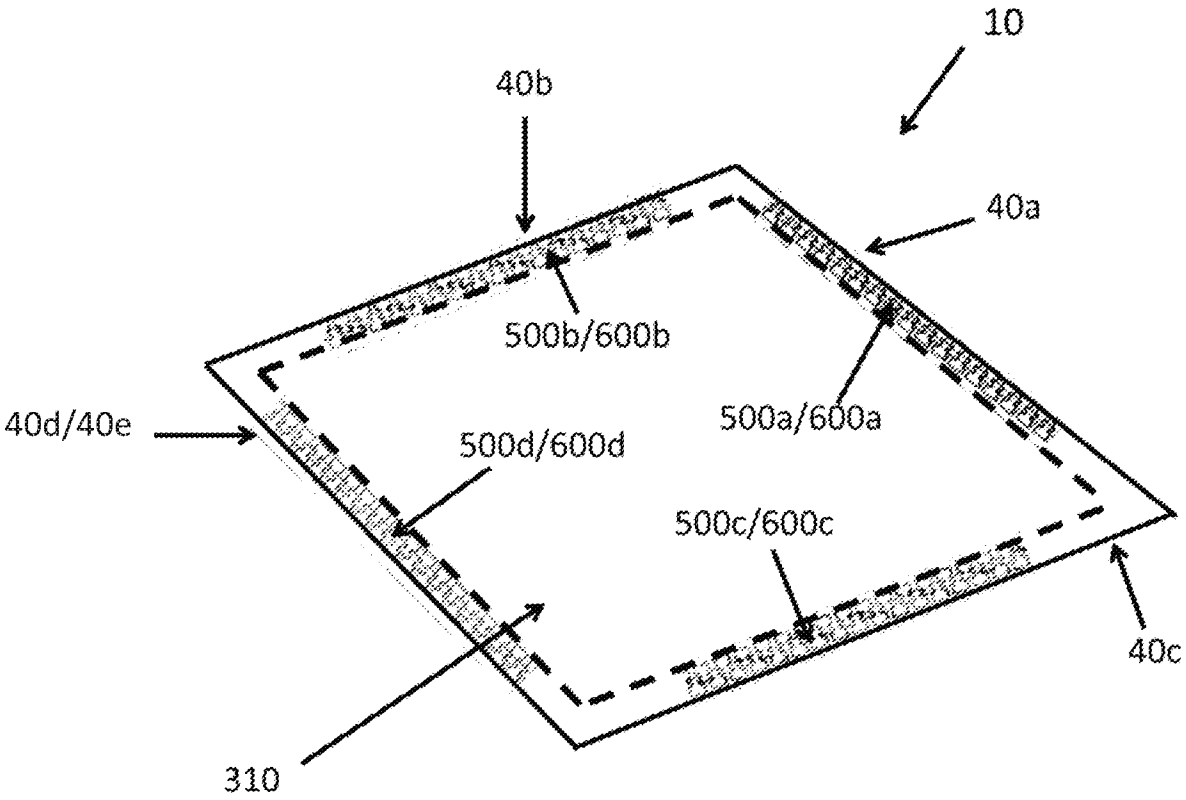
FIG. 15 is an example embodiment of a comforter connected to a duvet cover on each side.

FIG. 15 is an example embodiment of a comforter connected to a duvet cover on each side. In the example embodiment, comforter 310 (shown in broken lines) is connected to the interior of duvet cover 10 on each of its sides (in this case four sides) and duvet cover exterior sides 40*d* and 40*e* are in a closed position with respect to each other, as described previously with respect to FIG. 14.

Figure 16:
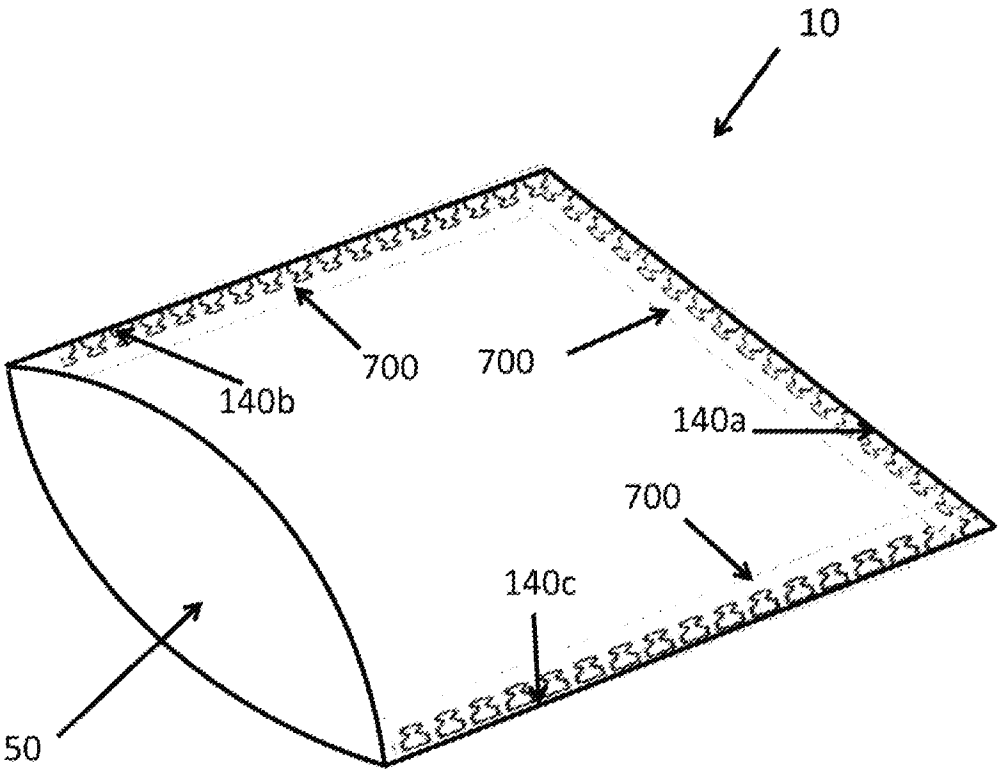
FIG. 16 is an example embodiment of a view of the interior of a duvet cover with a single monolithic fastener.

FIG. 16 is an example embodiment of a view of the interior of a duvet cover with a single monolithic fastener. In the example embodiment, duvet cover 10 includes a continuously running or monolithic fastener 700 which can be attached to duvet cover interior sides 140*a*, 140*b* and 140*c*. As such, this embodiment is different from that shown in FIG. 10 and previously described.

Figure 17:
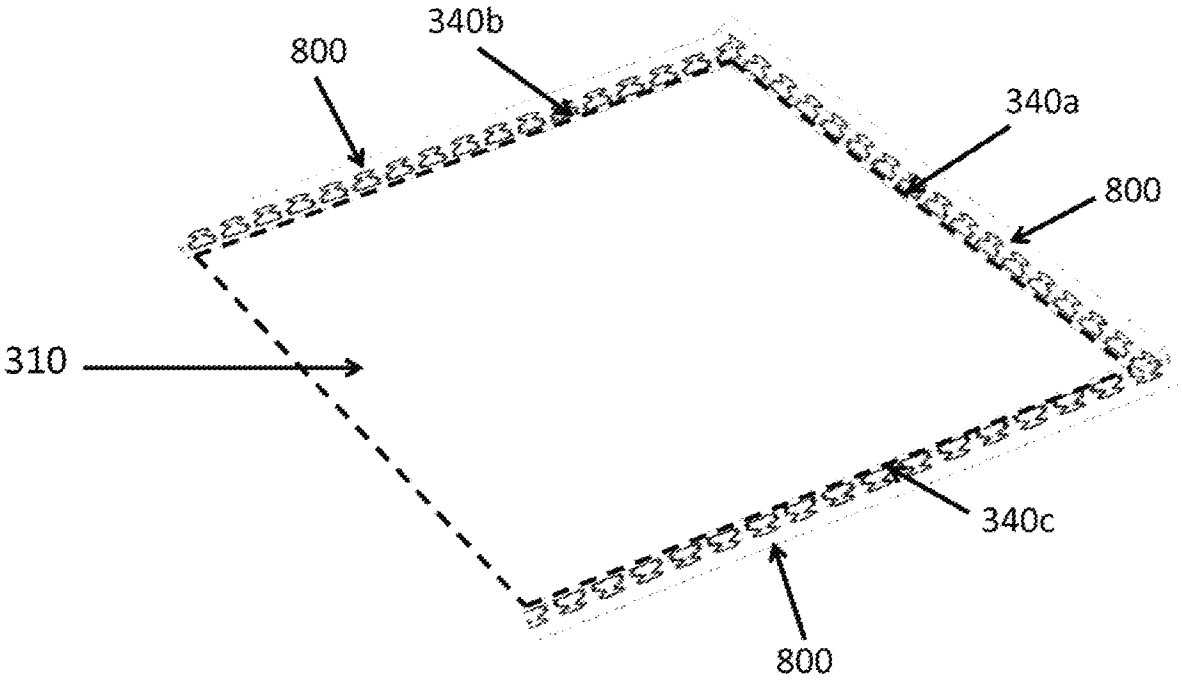
FIG. 17 is an example embodiment of a comforter with a single monolithic fastener.

FIG. 17 is an example embodiment of a comforter with a single monolithic fastener. In the example embodiment, comforter 310 (shown in broken lines) includes a continuously running or monolithic fastener 800 attached to comforter sides 340*a*, 340*b* and 340*c*. As such, this embodiment is different from that shown in FIG. 11 and previously described.

Figure 18:
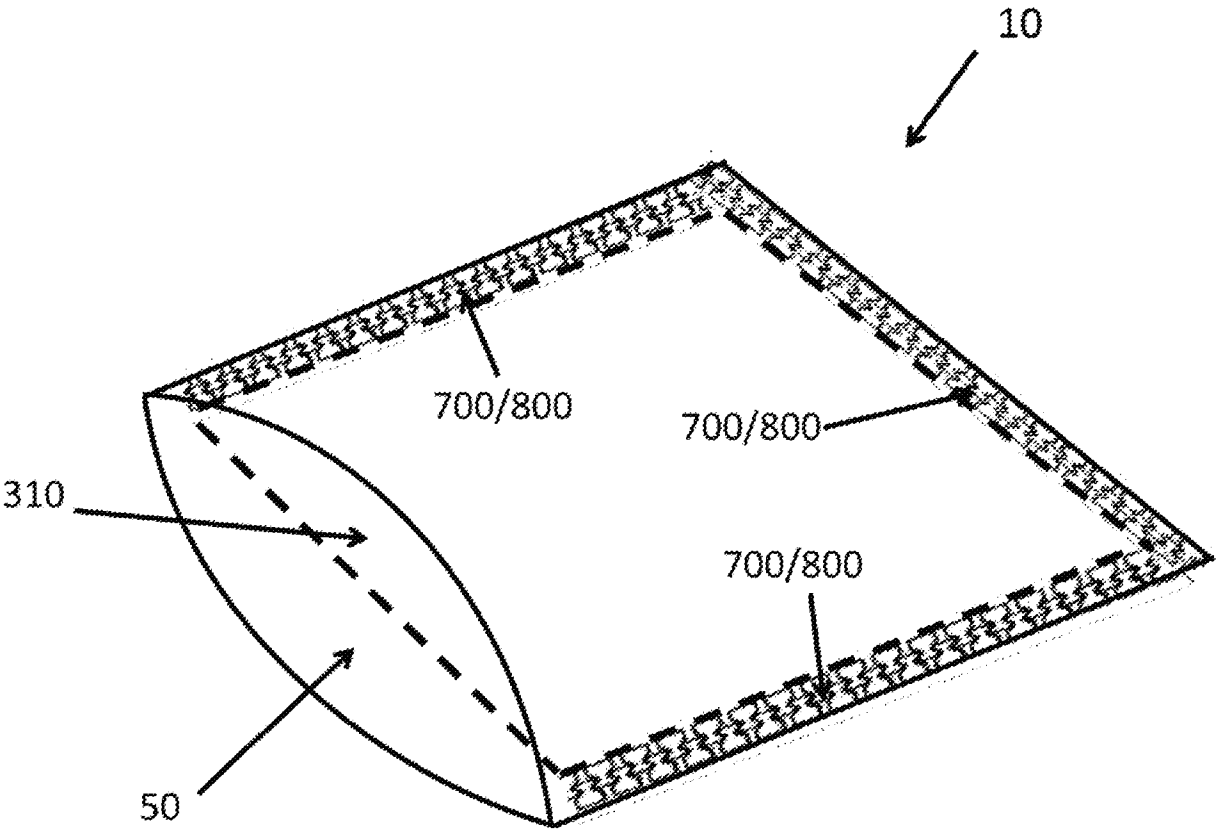
FIG. 18 is an example embodiment of a comforter and duvet cover attached by a single monolithic fastener.

FIG. 18 is an example embodiment of a comforter and duvet cover attached by a single monolithic fastener. In the example embodiment, comforter 310 (shown in broken lines) is inserted through opening 50 and connected or otherwise coupled to duvet cover 10 by joining continuously running or monolithic fastener 700 of duvet cover 10 to continuously running or monolithic fastener 800 of comforter 310.

Figure 19:
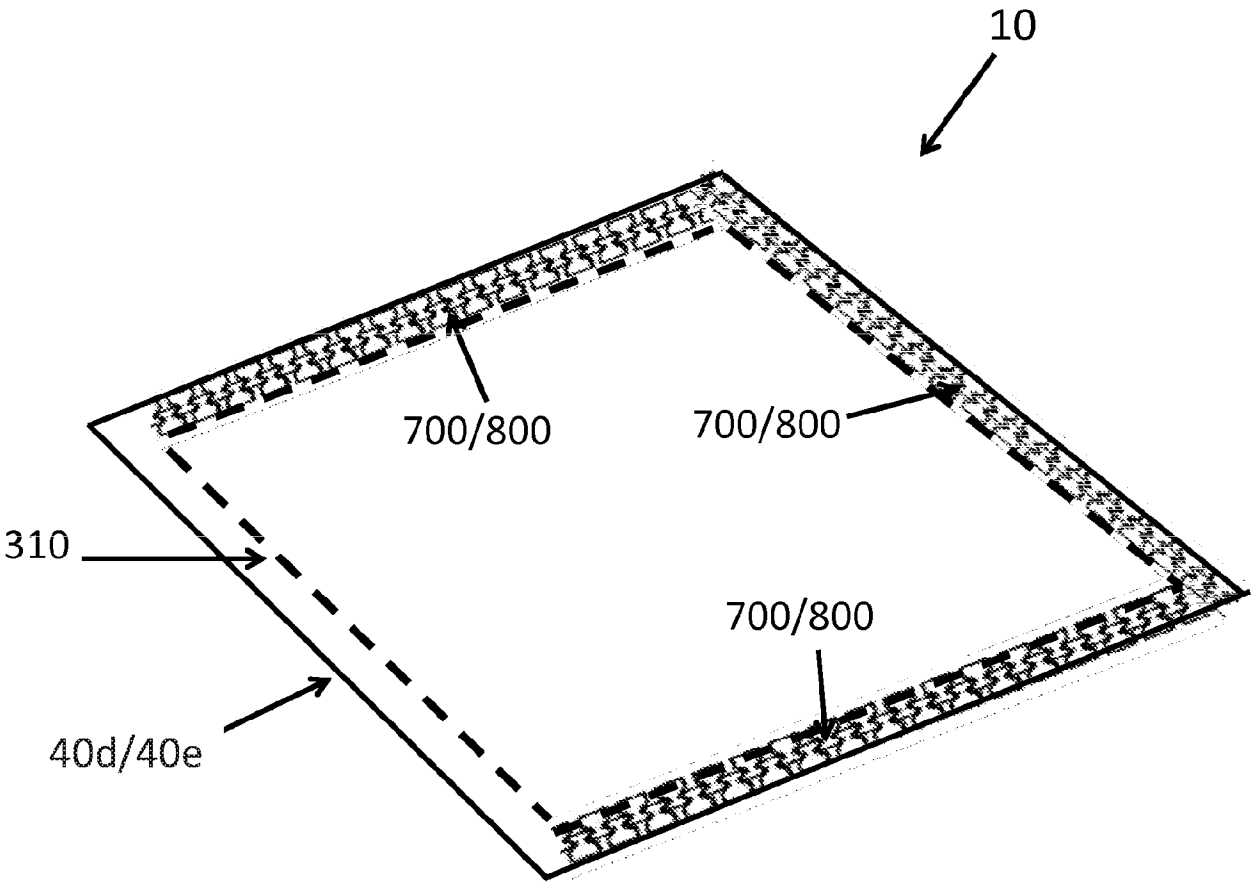
FIG. 19 is an example embodiment of a comforter and duvet cover attached by a single monolithic fastener with a duvet cover exterior side in a closed position.

FIG. 19 is an example embodiment of a comforter and duvet cover attached by a single monolithic fastener with a duvet cover exterior side 40*d*/40*e* in a closed position. Duvet cover exterior sides 40*d* and 40*e* are in a closed position with respect to each other, as described previously herein.

Figure 20:
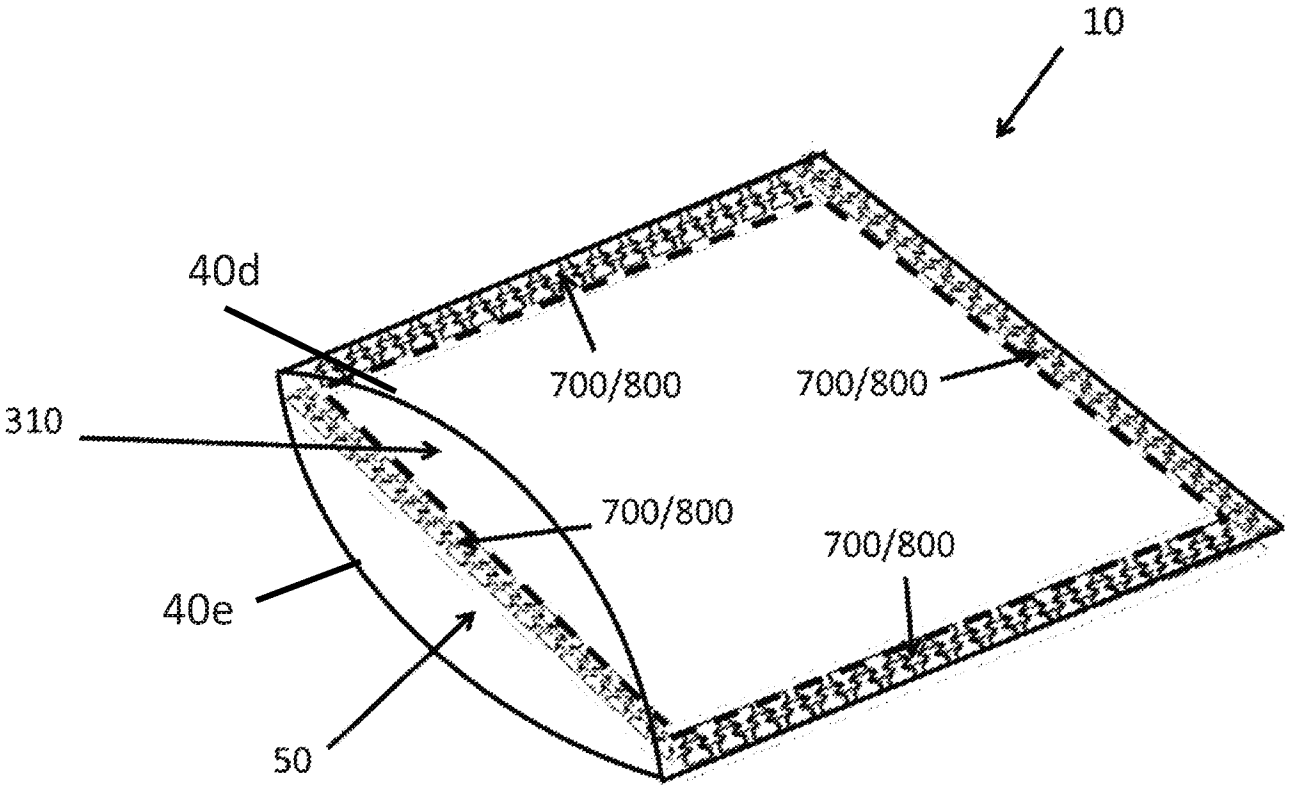
FIG. 20 is an example embodiment of a comforter connected to a duvet cover on multiple sides.

FIG. 20 is an example embodiment of a comforter connected to a duvet cover on multiple sides. In the example embodiment, comforter 310 (shown in broken lines) is connected to duvet cover 10 by joining a continuously running or monolithic fastener 700 of duvet cover 10 to continuously running or monolithic fastener 800 of comforter 310. Here, the continuously running or monolithic fastener 700 of duvet cover 10 can be attached to a single side 40*e* of duvet cover 10.

FIG. 21 an example embodiment of a hybrid view of both an interior and exterior of a duvet cover with fasteners attached to a comforter. As shown, various aspects of FIG. 20 can be seen.

FIG. 22 is an example embodiment of a hybrid view comforter attached to a duvet cover interior using monolithic fasteners. In the example embodiment, comforter 310 (shown in broken lines) is connected to duvet cover 10 by joining continuously running fastener 700 of duvet cover 10 to continuously running fastener 800 of comforter 310 with a duvet cover exterior sides 40*d* and 40*e* in a closed position.

FIG. 23 is an example embodiment of a view of an interior of a duvet cover with two opposing fasteners. In the example embodiment, duvet cover 10 includes two duvet cover interior side fasteners 500*b* and 500*c* attached to opposing interior sides 140*b* and 140*c* respectively.

FIG. 24 is an example embodiment of a comforter with two side fasteners. In the example embodiment, comforter 310 (shown in broken lines) includes two comforter side fasteners 600*b* and 600*c* attached to opposing sides 340*b* and 340*c* respectively.

FIG. 25 is an example embodiment of a comforter partially inserted into an interior of a duvet cover. In the example embodiment, comforter 310 (shown in broken lines) is partially inserted into duvet cover 10 through opening 50. Duvet cover interior side fastener 500*b* can attach to or otherwise join with comforter side fastener 600*b*. Duvet cover interior side fastener 500*c* can attach to or otherwise join with comforter side fastener 600*c*.

FIG. 26 is an example embodiment of a comforter with two side fasteners joined with a duvet cover with two opposing interior side fasteners. In the example embodiment, comforter 310 (shown in broken lines) is inserted through opening 50 and connected or otherwise coupled to duvet cover 10 by joining duvet cover interior side fastener 500*b* to comforter side fastener 600*b* and duvet cover interior side fastener 500*c* to comforter side fastener 600*c*.

FIG. 27 is an example embodiment of a comforter with a removable or attachable comforter side fastener. In the example embodiment, comforter 310 includes a comforter side fastener 600*b* attached to comforter side 340*b*. Comforter side fastener 600*b* can be affixed, attached or otherwise coupled along part or a whole of a comforter side by various means. In the example embodiment, it is attached by an end user by using an adhesive along its side 340*b* which can be on upper side 320 or lower side 330 or otherwise, as appropriate in various embodiments. Comforter side fasteners 600*b* can connect to a removable or attachable duvet cover interior side fastener (e.g. see 500*b* of FIG. 28) or a permanent duvet cover interior side fastener (e.g. see 500*a* of FIG. 4).

FIG. 28 is an example embodiment of a view of an interior of a duvet cover. In the example embodiment, duvet cover 10 includes an interior side fastener 500*b* which can connect to a removable or attachable comforter side fastener (e.g. see 600*b* of FIG. 27) or a permanent comforter side fastener (e.g. see 600*a* of FIG. 7). Fastener 500*b* can be affixed along part or a whole of a duvet side by various means. In the example embodiment it is attached by an end user by using an adhesive along interior side 140*b* of duvet cover 10.

FIG. 29 is an example embodiment of a comforter connected to a duvet cover. In the example embodiment, comforter 310 (shown in broken line) is connected or otherwise coupled or attached to duvet cover 10 by joining comforter side fastener 600*b* to duvet cover interior side fastener 500*b*.

FIG. 30 is an example embodiment of a comforter with two side fasteners. In the example embodiment, comforter 310 (shown in broken lines) includes two comforter side fasteners 600*b* and 600*c* (which can be adhesive side fasteners) attached to opposing sides 340*b* and 340*c* respectively.

FIG. 31 is an example embodiment of a view of an interior of a duvet cover with two opposing fasteners. In the example embodiment, duvet cover 10 includes two duvet cover interior side fasteners 500*b* and 500*c* (which can be adhesive side fasteners) attached to opposing interior sides 140*b* and 140*c* respectively.

FIG. 32 is an example embodiment of a comforter with two side fasteners joined with a duvet cover with two opposing interior side fasteners. In the example embodiment, comforter 310 (shown in broken lines) is connected to duvet cover 10 by joining duvet cover interior side fastener 500*b* to comforter side fastener 600*b* and duvet cover interior side fastener 500*c* to comforter side fastener 600*c*.

In various embodiments described herein and otherwise contemplated, fasteners can include zippers, hook and loop (Velcro), hook and eye, snaps, buttons, ties or various others as will be appreciated by one of skill in the art. Additionally, combinations thereof are contemplated, such as fasteners of one form (e.g. zipper) with attachment at fabric locations by backing using fasteners of another form (e.g. a series of buttons along a zipper backing). Adhesives can include various chemicals and compounds and can be in the form of strips, liquids, glues, aerosols, gel, putty, heat cured adhesives, iron-on adhesives or others as appropriate. Adhesives may be applied to fasteners at appropriate locations such as backing or strips attached to fasteners and may be manufactured with the fasteners or applied separately by end-users in various embodiments. Fasteners can be applied in some embodiments as follows: one half of an adhesive zipper can be applied to an interior of the duvet cover in an appropriate location as shown in the various figures described herein. In particular a first half of the adhesive fastener can be applied to a location of the interior of a duvet cover, such as near the side seam area. The second half of the adhesive fastener, operable to mate with the first half, can be applied to a location of a comforter to be joined with the duvet cover, such as near an edge of a comforter. When fastened, joined, coupled, connected, zipped, hooked, or otherwise attached together, the comforter and duvet cover will be joined such that they cannot freely move with respect to each other at the joined location, thereby hindering or preventing shifting, bunching and twisting of the comforter within the duvet cover during use.

An embodiment will now be described in which a fastener in the form of a zipper is included in a fabrication process to create a permanent connection. It should be understood from the disclosure herein that other fasteners can be used and variations on manufacturing are also possible.

Methods, systems and devices included herein can separate a zipper into two parts or halves, a male and female part respectively. One half of the zipper can be inserted between the top and bottom layers of a duvet cover so that a majority of zipper tape is hidden within the duvet cover layers, leaving only zipper teeth and a zipper slider and a very small portion of zipper tape visible to the eye from either an interior or exterior view. The other half of the zipper can be inserted between the top and bottom layers of the duvet (comforter) so that a majority of zipper tape can be hidden within the top and bottom layers, leaving only zipper teeth and zipper slider and a very small portion of zipper tape visible to the eye from an exterior view. Once the two halves of the zippers are aligned and engaged, for example, within an interior area of the duvet cover, the duvet cover and duvet (comforter) become connected.

The placement of the zippers can be important for several reasons:

Concealing zipper tape in between the top and bottom layers of both a duvet and duvet cover can prevent the zippers from becoming unattached from either the duvet or the duvet cover due to repeated use (zipping and unzipping), motion during a laundering process or movement during sleep.

In addition, concealment of zipper tape can be important because it can prevent damage to both the duvet & duvet cover from the zipper tape that may have sharp edges which could cause a tear in the fabric of either the duvet or duvet cover.

Also, zipper tape material can fray & break apart due to repeated use (zipping and unzipping), motion during the laundering process or movement during sleep, leading to inoperable zippers. Concealing and securing the zipper between the layers can protect from this and prevent fraying of fabric.

When zipper tape is attached by insertion between layers, the attachment can be more secure because the layers as well as sewing or otherwise stitching hold the zipper in place, resulting in a more secure and functional operation.

Positioning the zippers between layers can also create a clean, aesthetically-pleasing appearance for each piece.

A uniform placement of all sliders is contemplated in various embodiments. If multiple zippers are included, all halves of the zipper with sliders can be positioned on the duvet (comforter), with all non-slider halves on the duvet cover or the inverse positioning.

Due to the positioning of zippers described herein, users cannot see the duvet/duvet cover connection zippers as described herein once the duvet and duvet cover are attached, and the pieces are in their final position and the combination is seen from an exterior view. This can be important because having duvet/duvet cover connections on the exterior of the finished product can result in discomfort if the zipper comes in contact with the user and may even cause injury, skin irritation or other issues. Additionally, seeing duvet cover/duvet attachment zippers on the exterior is not aesthetically pleasing.

Additionally, the duvet covers described herein include interior edges which can connect directly to a duvet's exterior edges, leaving the body of the duvet free from attachment to the body of the duvet cover, allowing the two pieces to function together, while still allowing air to flow between the pieces for breathability. Separation of zippers allows for the comforter and duvet cover to be uncoupled and cleaned separately, as desired by a user.

In some embodiments a zipper construction and placement can include side length zippers which, when inserted within the layers of the duvet cover and duvet and then connected, can result in the slider of a zipper (the part of the zipper to be pulled by a user's hand when coupling or uncoupling zipper halves) terminating near the foot of the duvet/duvet cover combination. This can result in for comfort and uniformity. In order to achieve this effect, one side length zipper can be fitted with a right hand separator, and the other side length zipper can be fitted with a left hand separator.

In some embodiments described herein, duvet and duvet covers can be pre-manufactured in a factory and zippers can be added within the layers during the original manufacturing process of both the duvet and duvet covers. As such, manufacturing using CAD (Computer Aided Design), patterns can include making and manufacturing technology to create a precision fit.

As used herein and in the appended claims, the singular forms "a", "an", and "the" include plural referents unless the context clearly dictates otherwise.

The publications discussed herein are provided solely for their disclosure prior to the filing date of the present application. Nothing herein is to be construed as an admission that the present disclosure is not entitled to antedate such publication by virtue of prior disclosure. Further, the dates of publication provided may be different from the actual publication dates which may need to be independently confirmed.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

The invention claimed is:

1. A system of joining a duvet cover with a comforter, comprising:

a duvet cover, comprising:

two cover sheets, having two opposing interior surfaces and coupled around at least a portion of a perimeter, at an edge of each cover sheet, that defines an interior cavity, a cover fastener, coupled between the two cover sheets along a portion of the perimeter and having a cover fastening mechanism exposed within the interior cavity, wherein the perimeter coupling has a sealable opening along one side where the two sheets are removably coupled, such that a user can access the interior cavity of the duvet cover when the sealable opening is open; and a comforter, comprising:

two opposing exterior surfaces and operable to be inserted within the duvet cover through the sealable opening; and a comforter fastener, coupled between layers of the comforter and having a comforter fastening mechanism exposed along a side of the comforter, wherein the comforter fastener and the cover fastener are compatible and operable to be joined, such that when joined they at least partially prevent movement of the comforter with respect to the interior cavity of the duvet cover.

2. The system of claim 1, wherein the perimeter coupling of the first interior surface and the second interior surface is defined by a plurality of side edges of each cover sheet and the opening is defined by opposing but similar length side edges.

3. The system of claim 2, wherein the comforter fastener and the cover fastener are affixed along complementary side edges of the comforter and the interior cavity respectively.

4. The system of claim 3, wherein the comforter fastener is permanently affixed between layers of the comforter.

5. The system of claim 3, wherein the cover fastener is permanently affixed between the two cover sheets.

6. The system of claim 3, wherein the comforter fastener and the cover fastener are both permanently affixed.

7. The system of claim 3, wherein the comforter fastener is removably affixed between layers of the comforter.

8. The system of claim 3, wherein the cover fastener is removably affixed between the two cover sheets.

9. The system of claim 3, wherein the comforter fastener and the cover fastener are both removably affixed.

10. The system of claim 2, wherein the comforter fastener is one of a plurality of comforter fasteners and the cover fastener is one of a plurality of cover fasteners and each comforter fastener each cover fastener are affixed along complementary side edges of the comforter and the cover respectively, such that each cover fastening mechanism and comforter fastening mechanism can be coupled with its complementary located fastening mechanism, and wherein no comforter or cover fasteners are located along the sealable opening.

11. A bedding apparatus, comprising:

a duvet cover, comprising:

a plurality of sheets, coupled around a portion of perimeter at an edge of the cover sheets and defining an interior cavity;

a sealable opening along at least a portion of a side edge of the perimeter and providing access to the interior cavity; and a cover fastener, comprising:

an elongated cover fastener coupling strip; and a cover fastening mechanism, wherein the cover fastener coupling strip is affixed between the plurality of sheets and the cover fastening mechanism is located within the interior cavity; and a comforter, comprising:

a plurality of layers; and a comforter fastener, comprising:

an elongated comforter fastener coupling strip; and a comforter fastening mechanism, wherein the comforter fastener coupling strip is affixed between the plurality of layers and the comforter fastening mechanism is located exterior to the layers along a side of comforter, wherein the comforter fastener and the cover fastener are operable to be removably coupled, such that when joined they at least partially prevent movement of the comforter with respect to the interior cavity of the duvet cover.

12. The bedding apparatus of claim 11, wherein the sealable opening providing access to the interior cavity further comprises:

a first opening edge and an opposing second opening edge defining the opening;

a first opening fastener, comprising:

an elongated first opening fastener coupling strip; and a first opening fastening mechanism, wherein the elongated first opening coupling strip is affixed along the first opening edge; and a second opening fastener, an elongated second opening fastener coupling strip; and a second opening fastening mechanism, wherein the elongated second opening coupling strip is affixed along the second opening edge, wherein the first and second opening fastening mechanisms are operable to be removably coupled with each other.

13. The bedding apparatus of claim 12, wherein when the comforter fastener and the cover fastener are coupled within the interior cavity and the first and second opening fastening mechanisms are coupled, the comforter is completely enclosed within the interior cavity.

14. The bedding apparatus of claim 11, wherein the cover fastener extends substantially along one side of the interior cavity and the comforter fastener extends substantially along one side of the comforter.

15. The bedding apparatus of claim 14, wherein the sealable opening is located on a side of the perimeter opposite the side of the interior cavity where the cover fastener is affixed.

16. The bedding apparatus of claim 11, further comprising:

a sliding mechanism, wherein the cover fastening mechanism and the comforter fastening mechanism each comprise a plurality of compatible teeth that are operable to engage each other using the sliding mechanism.

17. The bedding apparatus of claim 11, wherein the cover fastener and the comforter fastener are both permanently affixed.

18. The bedding apparatus of claim 11, wherein the cover fastener and the comforter fastener are both removably affixed.

19. The bedding apparatus of claim 11, further comprising at least one additional cover fastener affixed to a side of the cover interior cavity between the sheets and at least one additional comforter fastener affixed to a side of the comforter between the layers, such that each such that each cover fastening mechanism and comforter fastening mechanism can be coupled with a complementary located fastening mechanism.

20. The bedding apparatus of claim 19, wherein no cover or comforter fasteners are located along the sealable opening of the perimeter.

* * * * *